US011094308B2

(12) United States Patent
Ichiki

(10) Patent No.: US 11,094,308 B2
(45) Date of Patent: Aug. 17, 2021

(54) KEYBOARD DEVICE

(71) Applicant: YAMAHA CORPORATION, Hamamatsu (JP)

(72) Inventor: Shunsuke Ichiki, Hamamatsu (JP)

(73) Assignee: YAMAHA CORPORATION, Hamamatsu (JP)

( * ) Notice: Subject to any disclaimer, the term of this patent is extended or adjusted under 35 U.S.C. 154(b) by 0 days.

(21) Appl. No.: 16/298,425

(22) Filed: Mar. 11, 2019

(65) Prior Publication Data

US 2019/0206378 A1 Jul. 4, 2019

Related U.S. Application Data

(63) Continuation of application No. PCT/JP2017/029172, filed on Aug. 10, 2017.

(30) Foreign Application Priority Data

Sep. 12, 2016 (JP) ..... JP2016-177359

(51) Int. Cl.
*G10H 1/34* (2006.01)
*G10H 1/00* (2006.01)
(Continued)

(52) U.S. Cl.
CPC ..... *G10H 1/344* (2013.01); *G10C 3/12* (2013.01); *G10C 3/18* (2013.01); *G10H 1/0008* (2013.01); *G10H 1/34* (2013.01)

(58) Field of Classification Search
CPC ..... G10H 1/344; G10H 1/0008; G10H 1/34; G10C 3/12; G10C 3/18
(Continued)

(56) References Cited

U.S. PATENT DOCUMENTS 3,199,396 A * 8/1965 Winch ..... G10C 3/12 84/423 R
3,209,637 A * 10/1965 Jewett ..... G10C 3/28 84/425
(Continued)

FOREIGN PATENT DOCUMENTS

JP H02111194 U 9/1990
JP 05045790 U * 6/1993
(Continued)

OTHER PUBLICATIONS

International Search Report issued in Intl. Appln. No. PCT/JP2017/029172 dated Oct. 31, 2017. English translation provided.
(Continued)

*Primary Examiner* — Christina M Schreiber
(74) *Attorney, Agent, or Firm* — Rossi, Kimms & McDowell LLP

(57) ABSTRACT

A keyboard device includes white keys, black keys adjacent to the white keys, and guides that are arranged between the white keys and the black keys and restrict operation by coming into contact with the white keys and the black keys. The keyboard device may further include a housing that covers parts of the white keys and the black keys, and the guide may be arranged in the region covered by the housing. The keyboard device may further include caps that are provided between the guides and the white keys and the guides and the black keys, and that have a lower Young's modulus than the guides.

14 Claims, 15 Drawing Sheets

(51) Int. Cl.
*G10C 3/12* (2006.01)
*G10C 3/18* (2006.01)

(58) Field of Classification Search
USPC ..... 84/609
See application file for complete search history.

(56) References Cited

U.S. PATENT DOCUMENTS 3,722,351 A * 3/1973 Allen ..... G10C 3/12 84/423 R
4,351,222 A * 9/1982 Kumano ..... G10H 1/344 84/177
4,628,792 A * 12/1986 Keast ..... G10C 3/12 84/423 R
4,658,695 A * 4/1987 Cutler ..... G10C 3/12 84/424
5,406,875 A * 4/1995 Tamai ..... G10H 1/344 84/433
5,796,023 A * 8/1998 Kumano ..... G10H 1/346 84/433
5,821,443 A * 10/1998 Masubushi ..... G10H 1/346 84/433
5,824,928 A * 10/1998 Kumano ..... G10C 3/12 84/423 R
5,929,357 A * 7/1999 Masubuchi ..... G10C 3/12 84/423 R
5,932,825 A * 8/1999 Kumano ..... G10C 3/16 84/423 R
6,407,321 B2 * 6/2002 Tamaki ..... G01V 8/20 84/18
7,297,854 B2 * 11/2007 Nishida ..... G10C 3/12 84/423 R
7,332,663 B2 * 2/2008 Nishida ..... G10C 3/12 84/423 R
7,488,885 B2 * 2/2009 Watanabe ..... G10C 3/12 84/423 R
7,586,030 B2 * 9/2009 Nishida ..... G10H 1/346 84/423 R
7,692,089 B2 * 4/2010 Nishida ..... G10H 1/32 84/644
7,696,424 B2 * 4/2010 Osuga ..... G10H 1/34 84/423 R
8,987,570 B2 * 3/2015 Osuga ..... G10H 1/34 84/433
10,311,847 B2 * 6/2019 Ichiki ..... G10H 1/346
10,373,596 B2 * 8/2019 Suzuki ..... G10H 1/346
10,529,311 B2 * 1/2020 Tanoue ..... G10H 1/344
2005/0160903 A1 * 7/2005 Nagaoka ..... G10H 1/344 84/745
2007/0017356 A1 * 1/2007 Nishida ..... G10H 1/346 84/744
2010/0071534 A1 * 3/2010 Kitajima ..... G10H 1/346 84/439
2011/0005370 A1 * 1/2011 Kitajima ..... G10H 1/346 84/744
2011/0017049 A1 * 1/2011 Shimoda ..... G10C 3/12 84/744
2016/0012809 A1 * 1/2016 Takata ..... G10H 1/34 84/433
2017/0278498 A1 * 9/2017 Suzuki ..... G10H 1/34
2018/0286367 A1 * 10/2018 Tanoue ..... G10H 1/344
2018/0286369 A1 * 10/2018 Ichiki ..... G10H 1/346
2019/0156804 A1 * 5/2019 Ogawa ..... G10H 1/346
2019/0206378 A1 * 7/2019 Ichiki ..... G10H 1/344
2019/0251939 A1 * 8/2019 Ichiki ..... G10C 3/12
2020/0005749 A1 * 1/2020 Ichiki ..... G10B 3/12

FOREIGN PATENT DOCUMENTS

JP 05143059 A * 6/1993
JP 05143060 A * 6/1993
JP H0545790 U 6/1993
JP 06266349 A * 9/1994
JP 2010008736 A 1/2010

OTHER PUBLICATIONS

Written Opinion issued in Intl. Appln. No. PCT/JP2017/029172 dated Oct. 31, 2017.

* cited by examiner

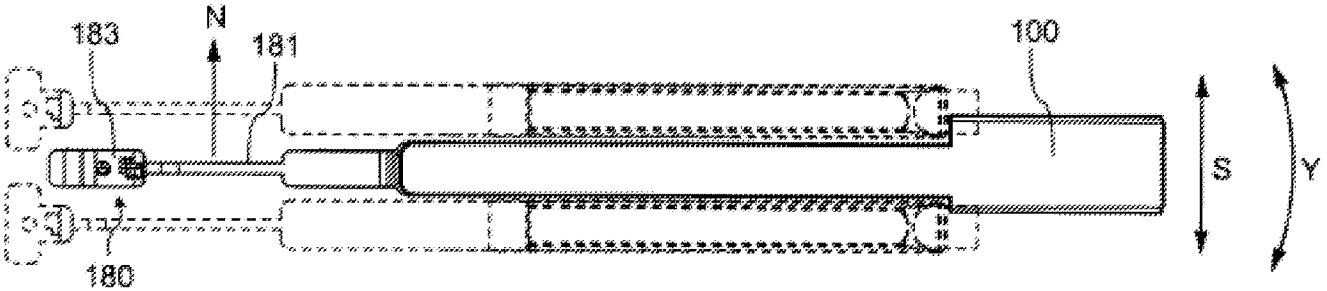
Fig. 7 (A)
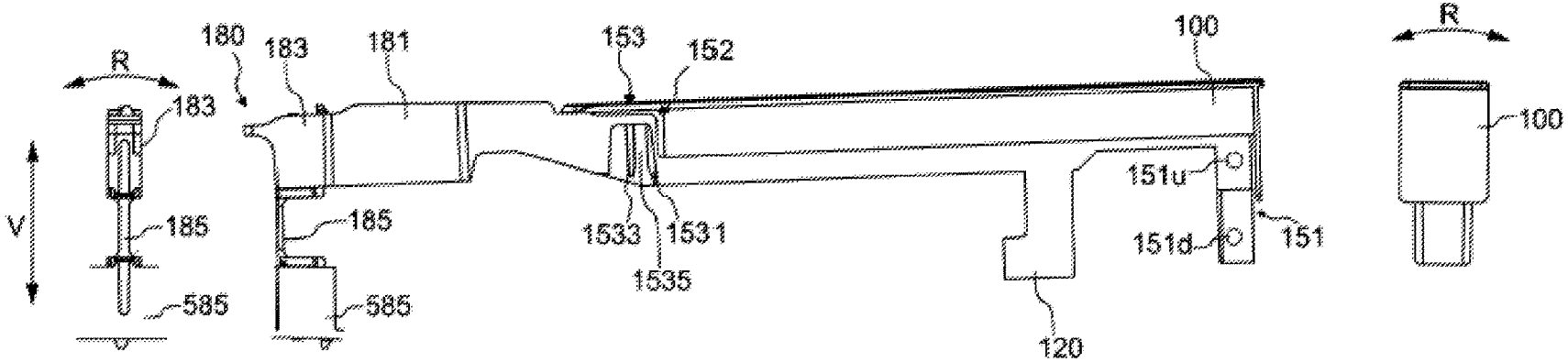
Fig. 7 (B)
Fig. 7 (C)
Fig. 7 (D)

KEYBOARD DEVICE

TECHNICAL FIELD

The present disclosure relates to a keyboard device.

BACKGROUND

A keyboard device includes multiple keys arranged side by side. The arrangement accuracy of the multiple keys has a large influence on the aesthetics of a musical instrument. For this reason, when deformation of the shapes of the keys occurs due to manufacturing error, this leads to the aesthetics of the musical instrument deteriorating. In view of this, a technique for adjusting the positions of the keys even if a manufacturing error has occurred has been developed (e.g., Patent Literature 1).

PATENT LITERATURE

Patent Literature 1: JP 2010-8736A

SUMMARY

With an electronic keyboard instrument such as an electronic piano, in general, keys are rotatably supported by frames on the rear end side (the far side from the point of view of a player) of the keys. The amount by which the keys can be pressed on their front end sides is designed to match that of an acoustic piano. On the other hand, the positions at which the keys are supported by the frames, that is, the rotational centers of the keys, are located on the performer side compared to the rotational centers of the keys in an acoustic piano.

According to this configuration, the lengths of the keys can be made shorter, and the size in the depth direction of the electronic keyboard instrument can be made shorter. In this case, the sensation during a key press is different for the keys of an electronic keyboard instrument and the keys of an acoustic piano since the positions of the rotational centers of the keys are different. On the other hand, when the keys of the electronic keyboard instrument are made longer and the rotational centers of the keys are moved to the far side, the size in the depth direction of the electronic keyboard instrument increases. Also, the influence of deformation caused by manufacturing error, change over time, and the like becomes more significant due to the keys being made longer. For example, if a key is bent in a scale direction, a longer key is more significantly influenced by deformation in the scale direction than a shorter key.

One object of the present disclosure is to reduce the influence of deformation, even if a key is deformed.

According to an embodiment of the present disclosure, a keyboard device including: a white key; a black key adjacent to the white key; and a guide that is arranged between the white key and the black key and restricts operation by coming into contact with the white key and the black key is provided.

BRIEF DESCRIPTION OF DRAWINGS

FIGS. 7(A), 7(B), 7(C), and 7(D) show diagrams illustrating a detailed structure of a key of an embodiment of the present disclosure.

DESCRIPTION OF EMBODIMENTS

Figure 1:
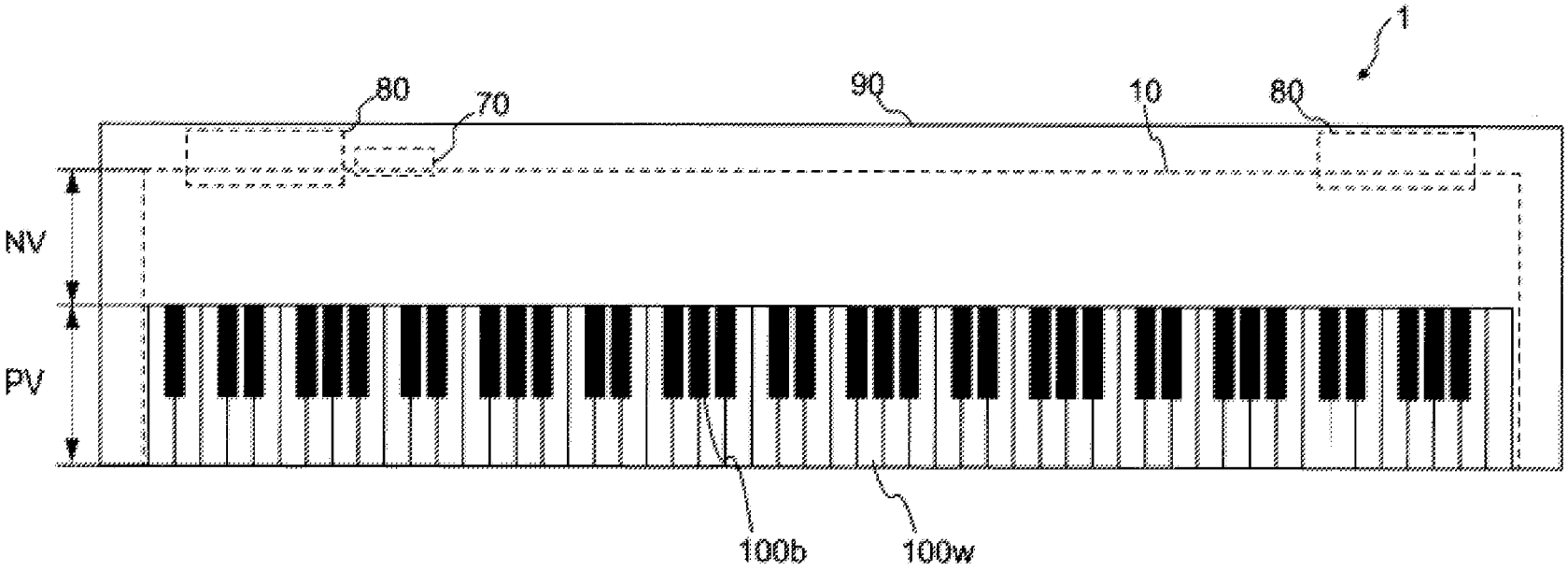
FIG. 1 is a diagram showing a configuration of a keyboard device of an embodiment of the present disclosure.

Hereinafter, a keyboard device of an embodiment of the present disclosure will be described in detail with reference to the drawings. The embodiments described below are examples of embodiments of the present disclosure and the present disclosure is not to be interpreted as being limited to these embodiments. Note that in the drawings referred to in the present embodiment, identical portions or portions having similar functions are denoted by identical or similar reference signs (reference signs with A, B, or the like attached to the end of a numeral), and repetitive description will be omitted in some cases. Also, the dimensional proportions in the drawings (proportions of configurations, proportions in the vertical, horizontal, and height directions, etc.) differ from the actual proportions and portions of configurations are omitted from the drawings for convenience of description in some cases.

First Embodiment

Configuration of Keyboard Device

FIG. 1 is a diagram showing a configuration of a keyboard device according to an embodiment of the present disclosure. In this example, a keyboard device 1 is an electronic keyboard instrument, such as an electronic piano, that generates sound in response to a key press performed by a user (player). Note that the keyboard device 1 may be a keyboard-type controller that outputs control data (e.g., MIDI) for controlling an external sound source device in response to a key press. In this case, the keyboard device 1 need not include a sound source device.

The keyboard device 1 includes a keyboard assembly 10. The keyboard assembly 10 includes white keys 100*w* and black keys 100*b*, and these multiple white keys 100*w* and black keys 100*b* are arranged side by side. The number of keys 100 is N, and is 88 in the example shown in FIG. 1. The direction in which the multiple white keys 100*w* and black keys 100*b* are arranged is called the scale direction. If description can be given without making a particular distinction between the white keys 100*w* and the black keys 100*b*, they will be referred to simply as keys 100 in some cases. Also, in the following description, if "w" is attached to the end of a reference numeral, this means that it is a configuration corresponding to a white key. Also, if "b" is attached to the end of a reference numeral, this means that it is a configuration corresponding to a black key.

Part of the keyboard assembly 10 exists inside of a housing 90. In other words, the housing 90 covers parts of the white keys 100*w* and the black keys 100*b*. The portion of the keyboard assembly 10 that is covered by the housing 90 when the keyboard device 1 is viewed from above is referred to as the non-external portion NV, and the portion that is exposed from the housing 90 and can be viewed by the user when the keyboard device 1 is viewed from above is referred to as the external portion PV. That is, the external portion PV is part of the keys 100, and indicates a region that can be operated for playing by the user. Hereinafter, the portions of the keys 100 that are exposed through the external portion PV will be referred to as key main body portions in some cases.

A sound source device 70 and a speaker 80 are arranged inside of the housing 90. The sound source device 70 generates a sound waveform signal accompanying a press of a key 100. The speaker 80 outputs the sound waveform signal generated in the sound source device 70 to an external space. Note that the keyboard device 1 may be provided with a slider for controlling volume, a switch for switching tones, a display for displaying various types of information, and the like.

Note that in the description of the present specification, directions such as up, down, left, right, front, and back indicate directions in the case where the keyboard device 1 is viewed by a player when playing. For this reason, for example, the non-external portion NV can be expressed as being located on the back side with respect to the external portion PV. Also, the direction is indicated using the keys 100 as a reference in some cases, such as key front end side (key front side) and key rear end side (key rear side). In this case, the key front end side is the near side from the viewpoint of the player with respect to the keys 100. The key rear end side is the far side from the viewpoint of the player with respect to the keys 100. According to this definition, in a black key 100*b*, the portion from the front end to the rear end of the key main body portion of the black key 100*b* can be expressed as being a portion that protrudes upward with respect to the white keys 100*w*.

Figure 2:
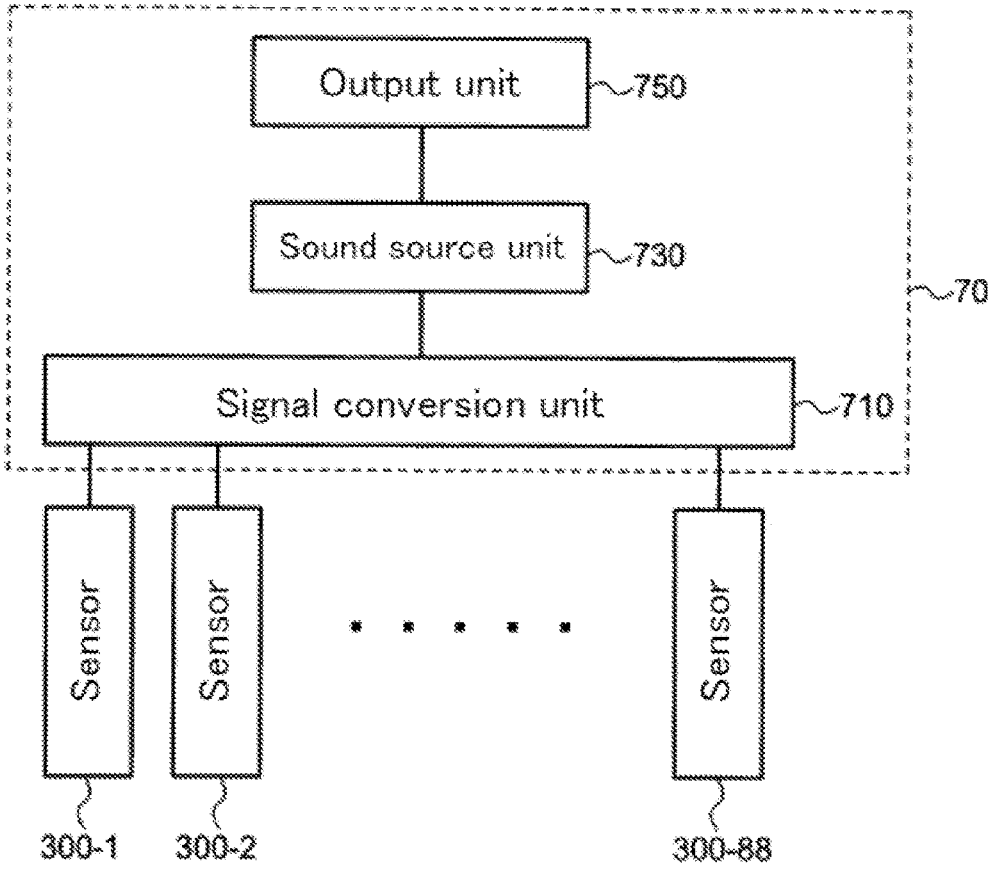
FIG. 2 is a block diagram showing a configuration of a sound source device of an embodiment of the present disclosure.

FIG. 2 is a block diagram showing a configuration of a sound source device according to an embodiment of the present disclosure. The sound source device 70 includes a signal conversion unit 710, a sound source unit 730, and an output unit 750. Sensors 300 are provided corresponding to the keys 100, detect operations of the keys, and output signals corresponding to the detected content. In this example, the sensor 300 outputs a signal corresponding to a three-step key press amount. A key press velocity can be detected according to the interval of this signal.

The signal conversion unit 710 acquires output signals of the sensors 300 (sensors 300-1, 300-2, . . . , and 300-88 corresponding to the 88 keys 100) and generates and outputs operation signals corresponding to the operation states of the keys 100. In this example, the operation signals are signals in a MIDI format. For this reason, the signal conversion unit 710 outputs "note on" in response to a key press operation. At this time, the key number indicating which of the 88 keys 100 were operated and the velocity corresponding to the key press velocity are also output in association with "note on". On the other hand, the signal conversion unit 710 outputs the key number and "note off" in correspondence with each other in response to a key release operation. A signal corresponding to another operation, such as a pedal, may be input to the signal conversion unit 710 and reflected in the operation signal.

The sound source unit 730 generates a sound waveform signal based on the operation signal output from the signal conversion unit 710. The output unit 750 outputs the sound waveform signal generated by the sound source unit 730. The sound waveform signal is output to the speakers 80, a sound waveform signal output terminal, or the like, for example.

Configuration of Keyboard Assembly

Figure 3:
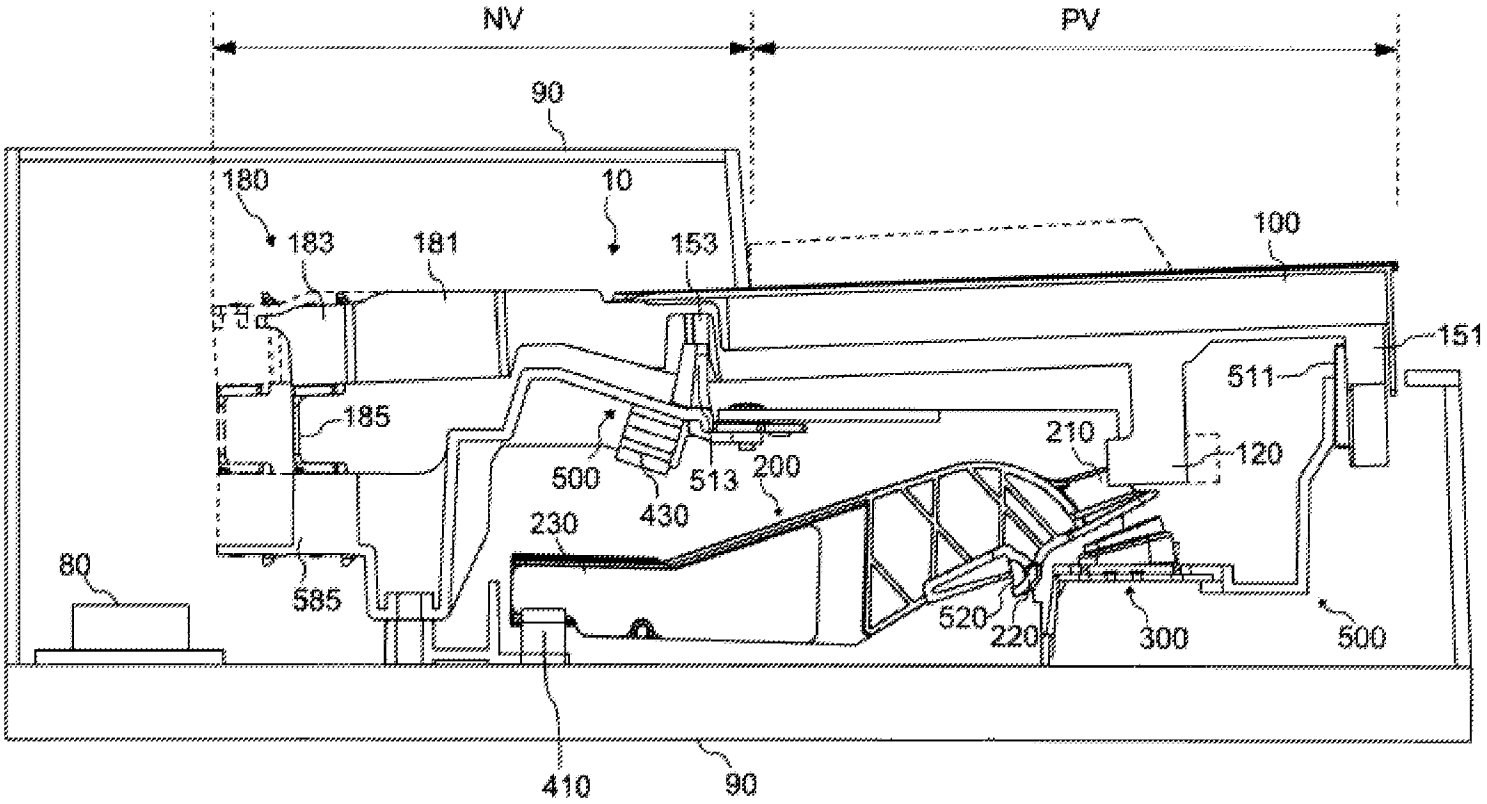
FIG. 3 is a diagram illustrating a side view of a configuration of a housing interior of an embodiment of the present disclosure.

FIG. 3 is a diagram illustrating a side view of a configuration of a housing interior according to an embodiment of the present disclosure. As shown in FIG. 3, the keyboard assembly 10 and the speakers 80 are arranged inside of the housing 90. The speakers 80 are arranged on the far side of the keyboard assembly 10. The speakers 80 are arranged so as to output sound corresponding to a key press above and below the housing 90. The sound output downward advances to the outside from the lower surface side of the housing 90. On the other hand, the sound output upward passes through the space inside of the keyboard assembly 10 from the interior of the housing 90 and advances to the outside from gaps between the neighboring keys 100 in the external portion PV and from gaps between the keys 100 and the housing 90.

The keyboard assembly 10 includes, in addition to the above-described keys 100, connection portions 180, a hammer assembly 200, and frames 500. Almost all configurations of the keyboard assembly 10 are structural bodies made of resin, which are manufactured through injection molding or the like. The frames 500 are fixed to the housing 90.

The keys 100 are rotatably connected to the frames 500 via the connection portions 180. Specifically, the connection portions 180 include plate-shaped flexible members 181, key-side support portions 183, and rod-shaped flexible members 185. The plate-shaped flexible members 181 extend from the rear ends of the keys 100. The key-side support portions 183 extend from the rear ends of the plate-shaped flexible members 181. The rod-shaped flexible members 185 are supported by the key-side support portions 183 and frame-side support portions 585 of the frames 500. That is, the rod-shaped flexible members 185 are arranged between the keys 100 and the frames 500. The keys 100 can rotate with respect to the frames 500 due to the rod-shaped flexible members 185 bending. Also, the rod-shaped flexible members 185 can be attached to and detached from the key-side support portions 183 and the frame-side support portions 585. Note that the rod-shaped flexible members 185 may not be attachable and detachable to and from the key-side support portions 183 and the frame-side support portions 585 or due to being made integral, adhesion, or the like.

The keys 100 include front end key guides 151 and side surface key guides 153. The front end key guide 151 covers a front end frame guide 511 of the frame 500 and slidably comes into contact with the front end frame guide 511. The front end key guide 151 is in contact with the front end frame guide 511 on both sides in the scale direction of the upper portion and the lower portion of the front end key guide 151. The side surface key guides 153 slidably come into contact with side surface frame guides 513 that extend upward from the frame 500 on both sides in the scale direction. In other words, the side surface key guides 153 and the side surface frame guides 513 are arranged in the region covered by the housing 90. In this example, the side surface key guides 153 and the side surface frame guides 513 are arranged in regions of the side surfaces of the key 100 corresponding to the non-external portion NV and exist on the key front end side with respect to the connection portion 180 (plate-shaped flexible member 181). However, the side surface key guides 153 and the side surface frame guides 513 may be arranged in the region corresponding to the external portion PV.

The hammer assembly 200 is rotatably attached to the frame 500. At this time, a shaft support portion 220 of the hammer assembly 200 and a rotation shaft 520 of the frame 500 slidably come into contact at at least three points. The front end portion 210 of the hammer assembly 200 slidably comes into contact in the approximate front-rear direction in the internal space of the hammer support portion 120. This sliding portion, that is, the portion at which the front end portion 210 and the hammer support portion 120 come into contact, is located below the key 100 in the external portion PV (forward with respect to the rear end of the key main body portion).

A weight portion 230 made of metal is arranged on the far side of the hammer assembly 200 with respect to the rotational shaft. Normally (when there is no key press), the weight portion 230 is placed on a lower-side stopper 410, and the front end portion 210 of the hammer assembly 200 pushes back the key 100. On the other hand, when a key press is performed, the weight portion 230 moves upward and collides with an upper-side stopper 430. The hammer assembly 200 applies added weight to the key press due to this weight portion 230. The lower-side stopper 410 and the upper-side stopper 430 are formed of a buffer material or the like (nonwoven cloth, elastic body, etc.).

The sensors 300 are attached to the frames 500 below the hammer support portions 120 and the front end portions 210. When the sensor 300 is pressed down by the lower surface side of the front end portion 210 due to a key press, the sensor 300 outputs a detection signal. As described above, the sensors 300 are provided corresponding to the keys 100.

Figure 4:
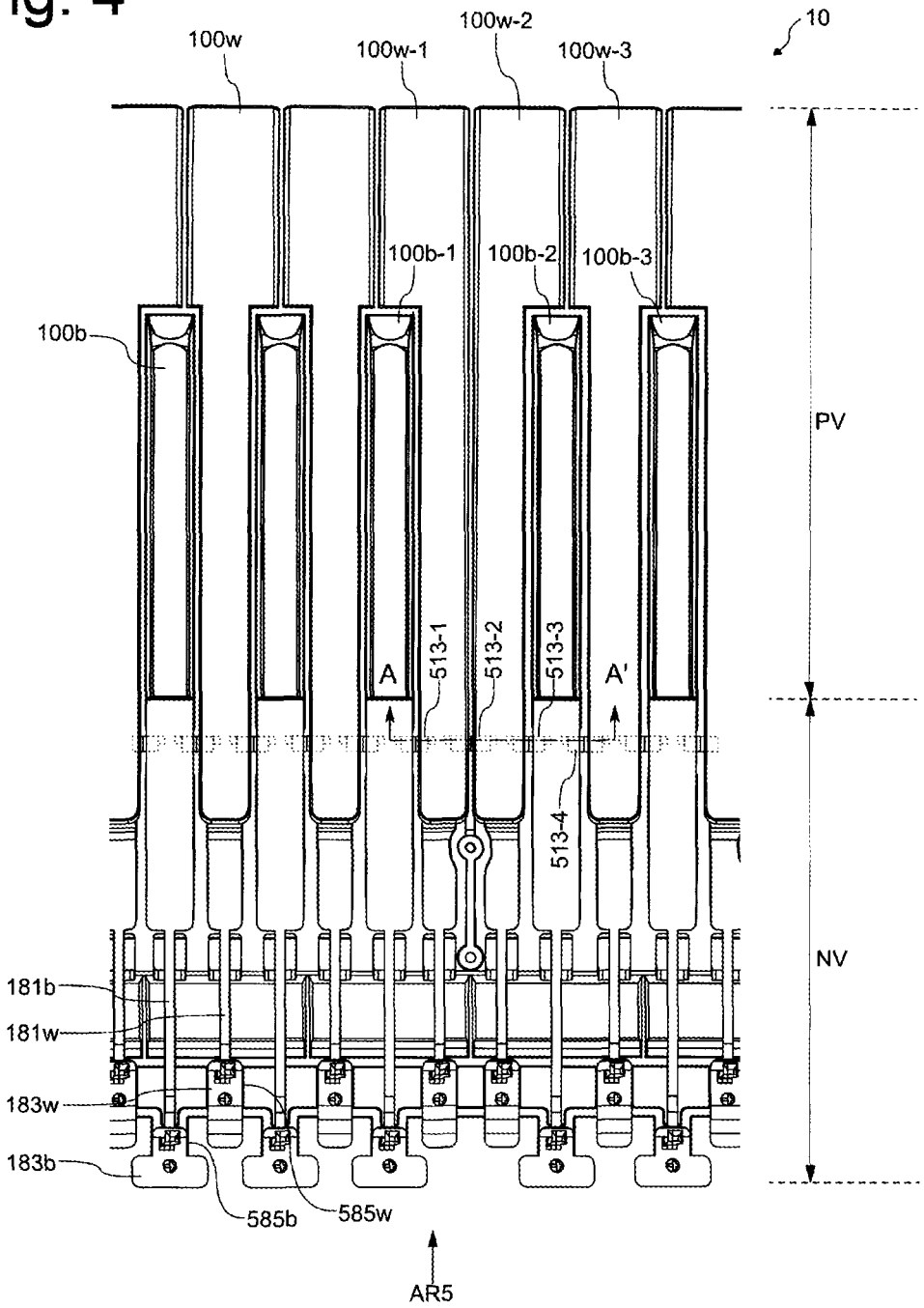
FIG. 4 is a diagram illustrating a top view of a keyboard assembly of an embodiment of the present disclosure.

FIG. 4 is a diagram illustrating a top view of a keyboard assembly according to an embodiment of the present disclosure. As shown in FIG. 4, key-side support portions 183*b* of the black keys 100*b* are arranged on the far side compared to key-side support portions 183*w* of the white keys 100*w*. This position relates to the position of the rod-shaped flexible member 185, which is the rotational center of the key 100. By using this kind of arrangement, the difference between the rotational centers of the white keys and black keys of an acoustic piano is reproduced. In this example, the plate-shaped flexible members 181*b* corresponding to the black keys 100*b* are longer than the plate-shaped flexible members 181*w* corresponding to the white keys 100*w*. In correspondence with this kind of arrangement, the frame-side support portions 585*b* of the frames 500 are arranged on the far side with respect to the frame-side support portions 585*w*. For this reason, the shape on the far side of the frames 500 (the frame-side support portions 585) is a shape in which the frame-side support portions 585*b* protrude to the far side with respect to the frame-side support portions 585*w*.

The side surface frame guides 513 are arranged between the adjacent keys 100 in the region corresponding to the non-external portion NV. For example, a side surface frame guide 513-1 is arranged between a black key 100*b*-1 and a white key 100*w*-1, and comes into contact with the black key 100*b*-1 and the white key 100*w*-1 to restrict one-directional operation in the scale direction of the black key 100*b*-1 and the white key 100*w*-1. The side surface frame guide 513-2 is arranged between the white key 100*w*-1 and the white key 100*w*-2, and comes into contact with the white key 100*w*-1 and the white key 100*w*-2 to restrict one-directional operation in the scale direction of the white key 100*w*-1 and the white key 100*w*-2. The side surface key guides 153 of the white key 100*w*-1 are interposed between the side surface frame guides 513-1 and 513-2, whereby two-directional operation in the scale direction of the white key 100*w*-1 is restricted.

FIG. 4 illustrates a configuration in which the side surface frame guides 513 are arranged in the non-external portion NV, but there is no limitation to this configuration. For example, the side surface frame guides 513 may be provided in the spaces from the key front ends to the key rear ends of the black keys 100*b* in the external portion PV.

Note that in FIG. 4, the configurations of the hammer assembly 200 and the frames 500 located below the keys 100 are shown with portions omitted. Specifically, the configurations (frame-side support portions 585, etc.) of the frames 500 near the connection portions 180 are shown, and portions such as the configurations on the near side are omitted. In other descriptions as well, portions are omitted in the drawings in some cases.

Figure 5:
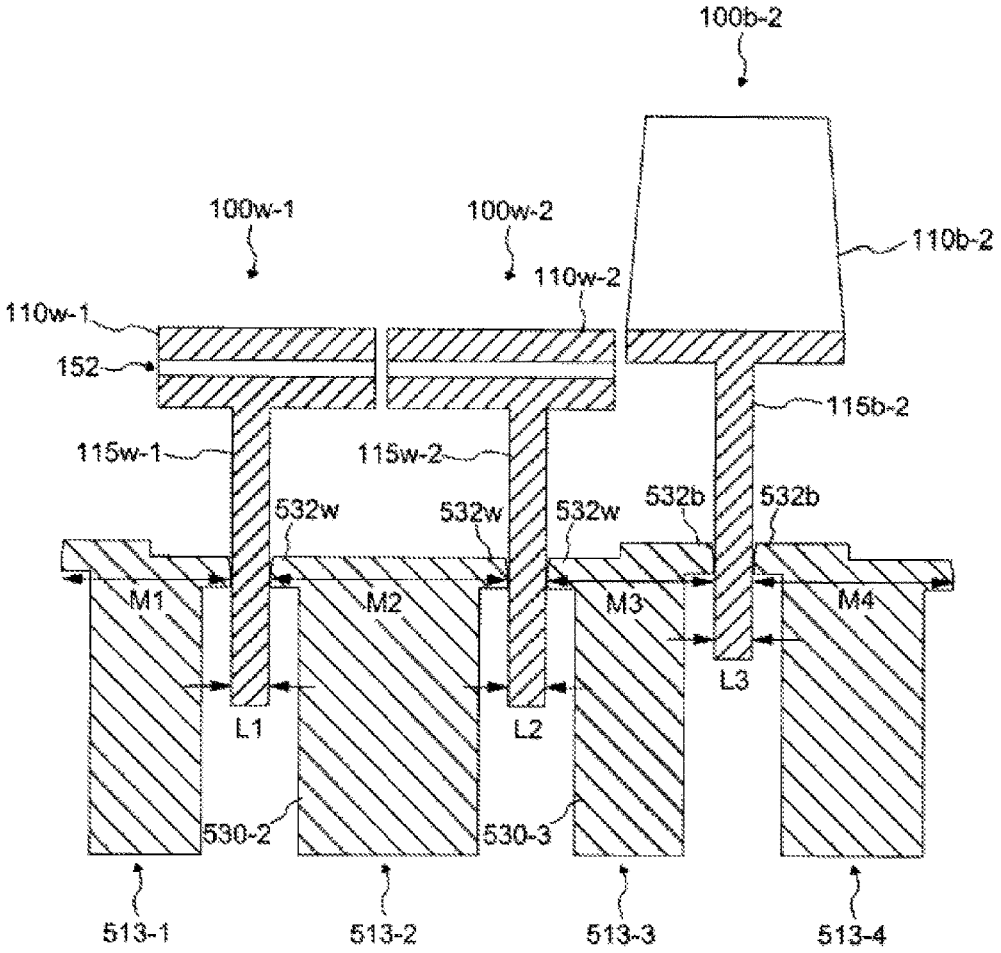
FIG. 5 is a cross-sectional diagram of keys and guides of a keyboard assembly of an embodiment of the present disclosure.

FIG. 5 is a cross-sectional diagram of keys and guides of a keyboard assembly according to an embodiment of the present disclosure. As shown in FIG. 5, the white key 100*w*-1 includes an upper surface portion 110*w*-1 and a protruding portion 115*w*-1. Note that a gap 152 is provided between the upper surface portion 110*w*-1 and the protruding portion 115*w*-1, although this will be described in detail later. The upper surface portion 110*w*-1 and the protruding portion 115*w*-1 correspond to the side surface key guide 153 (see FIG. 3). The protruding portion 115*w*-1 is connected to the upper surface portion 110*w*-1 and protrudes downward from the upper surface portion 110*w*-1. The protruding portion 115*w*-1 is formed into a shape with a T-shaped cross section, which includes an upward member that faces the upper surface portion 110*w*-1 and extends approximately horizontally, and a downward member that extends downward from the upward member and enters the space between adjacent side surface frame guides 513. Similarly, the white key 100*w*-2 includes an upper surface portion 110*w*-2 and a protruding portion 115*w*-2. Also, the black key 100*b*-2 includes an upper surface portion 110*b*-2 and a protruding portion 115*b*-2. Also, the protruding portion of the white key 100*w*-2 and the protruding portion of the black key 100*b*-2 are approximately similarly formed into shapes with T-shaped cross sections including an upward member and a downward member. No gap is provided between the upper surface portion 110*b*-2 and the protruding portion 115*b*-2 of the black key 100*b*-2. However, a gap may be provided between the upper surface portion 110*b*-2 and the protruding portion 115*b*-2. The protruding portion 115*b*-2 of the black key 100*b*-2 extends above (toward the side near the key 100) the protruding portion 115-1 of the white key 100*w*-1 and the protruding portion 115*w*-2 of the white key 100*w*-2. Note that the upper surface portions 110*w* of the white keys 100*w* and the upper surface portions 110*b* of the black keys 100*b* will be called upper surface portions 110 in some cases if description can be given without making a particular distinction therebetween. The protruding portions 115*w* of the white keys 100*w* and the protruding portions 115*b* of the black keys 100*b* will be called protruding portions 115 in some cases if description can be given without making a particular distinction therebetween.

With the protruding portion 115*b*-2 of the black key 100*b*-2, the downward member extends downward from the approximate center of the upward member in the scale direction. On the other hand, with the protruding portion 115*w*-1 of the white key 100*w*-1, the downward member extends downward from the left side (the side surface frame guide 513-1 side) with respect to the center of the upward member in the scale direction. Also, with the protruding portion 115*w*-2 of the white key 100*w*-2, the downward member extends downward from the right side (the side surface frame guide 513-3 side) with respect to the center of the upward member in the scale direction. That is, the shapes of the protruding portions 115*w*-1, 115*w*-2, and 115*b*-2 are different. Note that the shapes of the protruding portions 115*w*-1, 115*w*-2, and 115*b*-2 depend on the shapes of the keys of the existing keyboard assembly. However, the shapes of protruding portions corresponding to keys for the same note in adjacent octaves (e.g., the keys C3 and C4 corresponding to the "C" note) are the same.

Although FIG. 5 shows a portion of the multiple white keys 100*w* and the multiple black keys 100*b* provided in the keyboard assembly 10, the shapes of the protruding portions of the keys in one octave are all different. However, the shapes of the protruding portions 115*w* of the multiple white keys 100*w* may be the same, the shapes of the protruding portions 115*b* of the multiple black keys 100*b* may be the same, and the shapes of the protruding portions 115*w* and the shapes of the protruding portions 115*b* may be different, although this will be described in detail later. Alternatively, the shapes of the protruding portions 115*w* of the multiple white keys 100*w* and the shapes of the protruding portions 115*b* of the multiple black keys 100*b* may be the same.

Widths L1, L2, and L3 of the protruding portions 115*w*-1, 115*w*-2, and 115*b*-2 are the same. Note that unless otherwise specified, the widths of the above-described protruding portions 115 indicate the widths of the downward members of the protruding portions 115, which are interposed between the side surface frame guides 513. Similarly, unless otherwise specified, the protruding portions 115*w*-1, 115*w*-2, and 115*b*-2 indicate the downward members in the description in some cases. The widths L1, L2, and L3 of the above-described protruding portions are the same as the widths of the plate-shaped flexible members 181*w* and 181*b*. Although FIG. 5 shows a portion of the multiple white keys 100*w* and the multiple black keys 100*b* provided in the keyboard assembly 10, the widths of the protruding portions of all of the keys arranged in the keyboard assembly 10 are all the same. That is, the widths of the protruding portions 115*w* and 115*b* of the multiple white keys 100*w* and the multiple black keys 100*b* are the same. However, the widths of the protruding portions 115*w* of the multiple white keys 100*w* may be the same, the widths of the protruding portions 115*b* of the multiple black keys 100*b* may be the same, and the widths of the protruding portions 115*w* and the widths of the protruding portions 115*b* may be different. In other words, the widths in the scale direction of the multiple protruding portions 115*w*, the widths in the scale direction of the multiple protruding portions 115*b*, or the widths in the scale direction of the protruding portions 115*w* and the protruding portions 115*b* may be the same. In the scale direction, the protruding portions 115*w*-1 and 115*w*-2 are arranged at the same positions as the plate-shaped flexible members 181*w* corresponding to the white keys 100*w*, and the protruding portions 115*b*-2 are arranged at the same positions as the plate-shaped flexible members 181*b* corresponding to the black keys 100*b*.

Widths M2 and M3 in the scale direction of the side surface frame guides 513-2 and 513-3 differ according to the gap between the protruding portion 115*w*-1 and the protruding portion 115*w*-2 and the gap between the protruding portion 115*w*-2 and the protruding portion 115*b*-2. Note that in FIG. 5, the widths M1 to 4 in the scale direction of the side surface frame guides 513-1 to 4 are different. Note that the widths in the scale direction are distances between the leading ends of the sliding portions (referred to as contact portions) 532, which are provided on both ends of the later-described side surface frame guides 513. To rephrase the above-described characteristic, at least two of the side surface frame guides 513 among the multiple side surface frame guides 513 have different widths in the scale direction. However, if all of the distances between the protruding portions 115 of the adjacent keys 100 are the same, all of the widths in the scale direction of the side surface frame guide 513 can be made the same.

The side surface frame guides 513-1 to 531-4 include column portions 530 and sliding portions 532. Here, the sliding portions 532 of the side surface frame guides 513-1, 513-3, and 513-4 arranged between the black keys 100*b* and the white keys 100*w* include white key sliding portions 532*w* that come into contact with the white keys 100*w* and black key sliding portions 532*b* that come into contact with the black keys 100*b*. The white key sliding portions 532*w* and the black key sliding portions 532*b* are adjacent in the scale direction and the black key sliding portions 532*b* are arranged slightly upward. That is, level differences are formed between the white key sliding portions 532*w* and the black key sliding portions 532*b*. On the other hand, only the white key sliding portions 532*w* are formed on the sliding portions 532 of the side surface frame guide 513-2 arranged between the white keys 100*w*. Accordingly, this sliding portion 532 is formed into a flat shape.

On the other hand, the column portions 530 are fixed to the frames 500 and extend upward from the frames 500. The sliding portions 532 are fixed to the upper ends of the column portions 530 and extend from the column portions 530 toward the protruding portions 115. Due to the sliding portions 532 coming into contact with the protruding portions 115, one-directional operation in the scale direction of the keys 100 is restricted. As described above, the black key sliding portions 532*b* are arranged above the white key sliding portions 532*w*. That is, the positions at which the black key sliding portions 532*b* and the protruding portions 115*b* come into contact are located above the positions at which the white key sliding portions 532*w* and the protruding portions 115*w* come into contact. In other words, the positions at which the black key sliding portions 532*b* and the protruding portions 115*b* come into contact are located nearer to the upper surface portions 110 of the keys 100 than the positions at which the white key sliding portions 532*w* and the protruding portions 115*w* come into contact are. To rephrase further, the positions at which the black key sliding portions 532*b* and the protruding portions 115*b* come into contact are further from the frames 500 than the positions at which the white key sliding portions 532*w* and the protruding portions 115*w* come into contact are.

The side surfaces of the sliding portions 532 include vertical surfaces and inclined surfaces. The inclined surfaces are provided above the vertical surfaces. In other words, the inclined surfaces are provided on the upper surface portion 110 side with respect to the vertical surfaces. Due to the side walls of the sliding portions 532 having the inclined surfaces, the gaps between the adjacent sliding portions 532 expand toward the upper surface portions 110.

Figure 6:
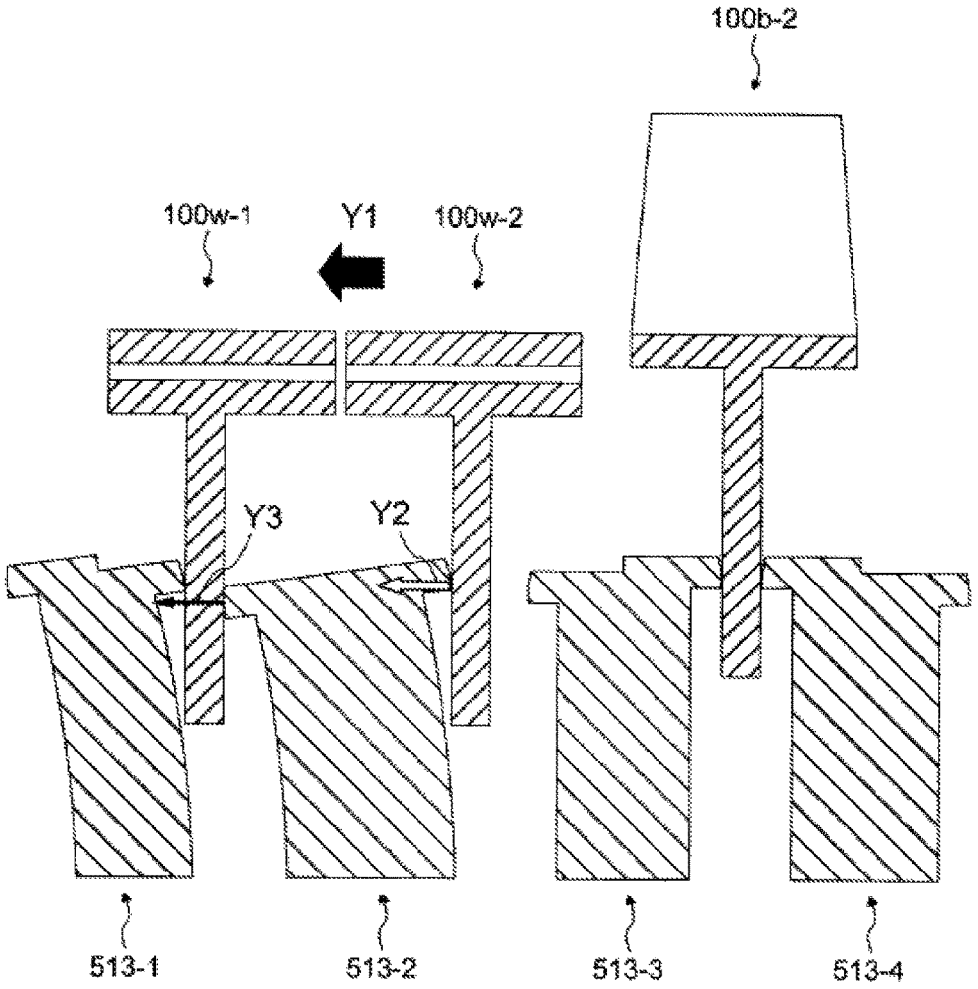
FIG. 6 is a cross-sectional diagram illustrating an operation of keys and guides in a keyboard assembly of an embodiment of the present disclosure.

FIG. 6 is a cross-sectional diagram illustrating operations of keys and guides in a keyboard assembly according to an embodiment of the present disclosure. In FIG. 6, for example, a state is shown in which the shape of the white key 100*w*-2 has deformed and the white key 100*w*-2 at the position at which the side surface frame guide 513 has been arranged in the front-rear direction of the keys 100 has moved in the direction of arrow Y1. When the white key 100*w*-2 moves in the direction of the arrow Y1, the side surface frame guide 513-2 receives the action in the direction of the arrow Y2 from the white key 100*w*-2 and inclines in the direction of the arrow Y2. Accordingly, the white key 100*w*-1 receives the action of arrow Y3 from the side surface frame guide 513-2 and moves in the direction of the arrow Y3. As described above, due to the side surface frame guide 513-2 being arranged between the white key 100*w*-1 and the white key 100*w*-2, for example, it is possible to suppress a case in which the white key 100*w*-2 comes into contact with the white key 100*w*-1, even if the shape of the white key 100*w*-2 deforms.

Structure of White Key

FIG. 7 shows diagrams illustrating a detailed structure of a key according to an embodiment of the present disclosure. FIG. 7(A) is a diagram of a white key 100*w* viewed from above. FIG. 7(B) is a diagram of a white key 100*w* viewed from the side (left side). FIG. 7(C) is a diagram showing a connection portion 180 viewed from the far side. FIG. 7(D) is a diagram showing a white key 100*w* viewed from the near side.

First, directions that will be used in the following description (scale direction S, rolling direction R, yawing direction Y, vertical direction V) will be defined. As described above, the scale direction S corresponds to the direction in which the keys 100 are arranged (the left-right direction from the player's perspective). The rolling direction R corresponds to the direction in which the extension direction of the keys 100 (the direction from the near side to the far side from the player's perspective) rotates about an axis. The yawing direction Y is the direction in which the key 100 bends in the left-right direction when viewed from above. Although there is little difference between the scale direction S and the yawing direction Y, movement in the scale direction S of the keys 100 means horizontal movement, whereas movement in the yawing direction Y of the keys 100 corresponds to bending (warping) in the scale direction S. The vertical direction V corresponds to the direction in which the rod-shaped flexible members 185 extend (the vertical direction from the player's perspective) and can also be said to be the direction of the axis of bending in the yawing direction Y.

The key 100 is provided with the front end key guide 151 and the side surface key guides 153. As described above, the front end key guide 151 comes into contact with the front end frame guide 511 of the frame 500 at the upper portion and the lower portion of the front end key guide 151. For this reason, the front end key guide 151 is actually divided into an upper portion key guide 151*u* and a lower portion key guide 151*d*. Thus, the front end key guide 151 (upper portion key guide 151*u*, lower portion key guide 151*d*) and the side surface key guides 153 restrict the movement of the key 100 in three locations not arranged side by side on a straight line in a view of the key 100 in the scale direction S. According to the at least three guides provided in this manner, movement of the key 100 is restricted in the scale direction S, the yawing direction Y, and the rolling direction R. In particular, due to the side surface frame guides 513 being arranged between the adjacent keys 100, it is possible to suppress a case in which the adjacent keys 100 come into contact, even if the keys 100 move in the scale direction S in the non-external portion NV.

Note that in this example, the side surface key guide 153 also restricts movement in the front-rear direction of the key 100 due to the side surface frame guide 513 sliding in a groove 1535 formed by lateral protruding portions 1531 and 1533. The number of guides may be three or more. In this case, there is no need to satisfy a requirement that all of the guides are not aligned side by side in a straight line, and it is sufficient that at least three guides satisfy this condition. Note that the location of the key 100 in the groove 1535 corresponds to the protruding portion 115 in FIG. 5. A gap 152 is provided between the side surface key guide 153 and the upper surface of the key 100. The gap 152 mitigates the influence that the deformation of the key 100 has on the side surface key guide 153.

The plate-shaped flexible member 181 is a flexible plate-shaped member. The plate-shaped flexible member 181 is arranged such that the normal line direction N of the plate surface faces the scale direction S. Accordingly, the plate-shaped flexible member 181 can deform in the rolling direction R and the yawing direction Y by bending and twisting. That is, the plate-shaped flexible member 181 has a degree of freedom in the rolling direction R and the yawing direction Y of the key 100 due to its flexibility. The plate-shaped flexible member 181 can also be said to have a degree of freedom in the scale direction S as well by combining deformations in the yawing direction Y. On the other hand, the plate-shaped flexible member 181 hardly deforms at all in the vertical direction. Note that the normal line direction N need not completely match the scale direction S, and need only include a component in the scale direction S. If they do not match, the angle formed by the normal line direction N and the scale direction S is preferably as small as possible.

The rod-shaped flexible member 185 is a flexible rod-shaped member. Accordingly, the rod-shaped flexible member 185 can deform in the rolling direction R and the yawing direction Y by bending and twisting. That is, the rod-shaped flexible member 185 has a degree of freedom in the rolling direction R and the yawing direction Y of the key 100 due to its flexibility. The rod-shaped flexible member 185 can also be said to have a degree of freedom in the scale direction S as well by combining deformations in the rolling direction R. On the other hand, the rod-shaped flexible members 185 hardly deform at all in the vertical direction. Note that due to its shape characteristic, the amount by which the rod-shaped flexible member 185 can twist is greater than that of the plate-shaped flexible member 181.

The cross-sectional shape (cross section orthogonal to the lengthwise direction of the rod shape) of the rod-shaped flexible member 185 is a shape surrounded by a combination of curved lines and straight lines, and in this example, it is a hemispherical shape. In the hemispherical shape, the straight line portion is on the far side, and the curved line portion is on the near side, but the direction may be inverted. Note that the cross-sectional shape of the rod-shaped flexible member 185 may be a shape surrounded only by curved lines (e.g., a circular shape), or may be a shape surrounded only by straight lines (e.g., a rectangular shape). That is, as long as the rod-shaped flexible member 185 can undergo a bending deformation in directions (two directions among the three directions defining the third dimension) other than the lengthwise direction (vertical direction) and can undergo a twisting deformation with the lengthwise direction serving as the axis, the cross-sectional shape may be any shape. The thickness of the rod-shaped flexible member 185 may change in the lengthwise direction, as with a conic shape or the like.

In this manner, the connection portion 180 not only allows the key 100 to rotate in the pitch direction (the rotation direction of a normal key press) with respect to the frame 500, but can also deform in the rolling direction R and the yawing direction Y, while making it so that displacement in the vertical direction hardly occurs at all (movement in the vertical direction of the rotation center hardly occurs at all) with respect to a strong force, namely a key press, in the key rearward portion (far side) with respect to the side surface key guide 153. That is, the connection portion 180 not only allows the key 100 to rotate with respect to the frame 500, but can also deform in the rolling direction R and the yawing direction Y. Although movement of the connection portion 180 is restricted in the vertical direction, the connection portion 180 has a degree of freedom in the rolling direction R and the yawing direction Y of the key 100. As described above, the connection portion 180 can also be said to have a degree of freedom in the scale direction S as well by combining deformations in the rolling direction R.

As described above, the key 100 sometimes causes deformation including the yawing direction Y and the rolling direction R due to manufacturing error and change over time. In this case, the influence of the deformation of the key 100 is made as unnoticeable as possible in the external portion PV due to restriction achieved by the front end key guide 151 and the side surface key guide 153. On the other hand, since the influence of the deformation is suppressed in the external portion PV, the influence of the deformation is significant in the non-external portion NV. This is because the longer the key 100 is, the more prominent the influence is.

For example, in a first example, a case is envisioned in which there is deformation in which the key 100 gradually twists (deformation in the rolling direction R). In this case, the orientation in the rolling direction R of the front end portion of the key 100 is restricted so as to be in the perpendicular direction due to the upper portion key guide 151*u* and the lower portion key guide 151*d*, and therefore the key 100 is more influenced by the deformation in the rolling direction R toward the far side. Also, in a second example, a case is envisioned in which there is deformation in which the key 100 gradually bends in the scale direction S (deformation in the yawing direction Y). In this case, the position in the scale direction S of the key 100 in the external portion PV is restricted by the front end key guide 151 and the side surface key guide 153, and therefore the key 100 is more influenced by the deformation in the yawing direction Y toward the far side. Note that even if the side surface frame guide 513 is inclined due to deformation of the key 100 in the yawing direction, the side surface frame guide 513 presses the key 100 adjacent in the direction in which the key 100 deformed in that direction, and therefore a case is suppressed in which the keys 100 come into contact with each other.

In either case, due to the influence of the deformation of the key 100, the positions of the portion that is the rotational center of the key 100 and the frame 500 shift. That is, the positional relationship between the connection portion 180 connected to the key 100 and the frame-side support portion 585 shifts.

On the other hand, with the key 100 of the first embodiment, the plate-shaped flexible member 181 and the rod-shaped flexible member 185 can deform due to being flexible, and thus the influence of the shifting in the positions of the key 100 and the frame-side support portion 585 can be suppressed due to the deformation of the connection portion 180 (plate-shaped flexible member 181 and rod-shaped flexible member 185). In this case, the rod-shaped flexible member 185 not only has a function serving as a member that allows the key 100 to rotate in the pitch direction due to being capable of bending in the front-rear direction of the key 100, but also has a function serving as a member that absorbs the influence of the deformation of the key 100, while making it so that displacement in the vertical direction hardly occurs at all (movement in the vertical direction of the rotation center hardly occurs at all) with respect to a strong force, namely, a key press.

Also, as described above, due to the fact that the influence of the deformation of the key 100 is made as unnoticeable as possible in the external portion PV, the positional accuracy in the scale direction S also increases. For this reason, the front end portion 210 of the hammer assembly 200 detected by the sensor 300 and the hammer support portion 120 of the key 100 connected to the front end portion 210 are preferably provided below the key 100 in the external portion PV (frontward with respect to the rear end of the key main body portion).

Comparison of White Keys and Black Keys

Figure 8:
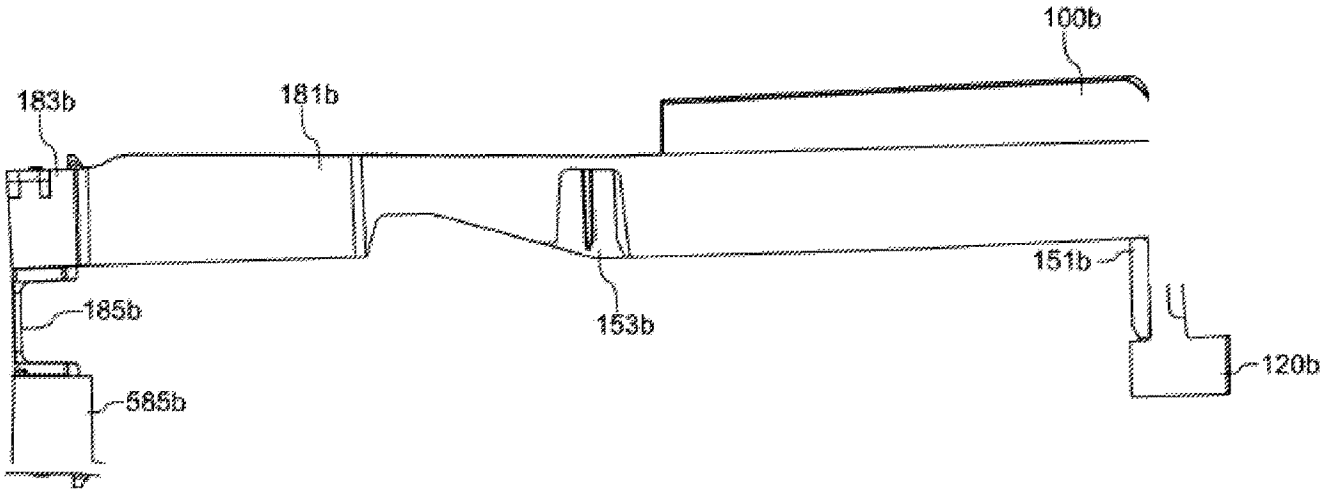
FIGS. 8(A) and 8(B) show diagrams illustrating a structure of a black key of an embodiment of the present disclosure, in comparison with a structure of a white key.
Figure 8:
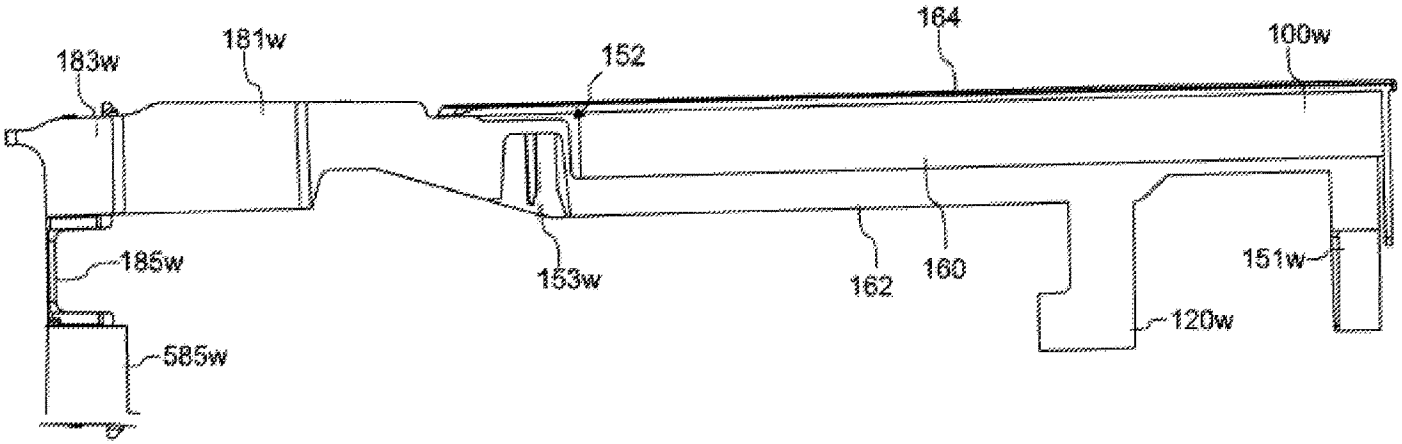

FIG. 8 is a diagram illustrating a structure of a black key according to an embodiment of the present disclosure, in comparison with a structure of a white key. FIG. 8(A) shows a black key. FIG. 8(B) shows a white key. In FIGS. 8(A) and 8(B), the positions in the front-rear directions of the white keys 100*w* and the black keys 100*b* are shown as being associated. The white keys 100*w* and the black keys 100*b* differ in the following respects. First, the plate-shaped flexible member 181*b* is longer than the plate-shaped flexible member 181*w*. In this example, due to this difference, the positions of the rotational centers of the keys are different, but the positions of the rotational centers of the keys may be made different through a method other than this. For example, the lengths of the black keys 100*b* may be made longer while the plate-shaped flexible members 181*w* and the plate-shaped flexible members 181*w* are set to the same length.

Next, the side surface key guide 153*w* of the white key 100*w* and the side surface key guide 153*b* of the black key 100*b* are provided at almost the same positions in the front-rear direction of the keys. The white keys 100*w* include a wooden portion 160, a white key lower portion frame 162, and a white key top plate portion 164. The white key lower portion frame 162 and the white key top plate portion 164 are made of a resin material. The wooden portion 160 is made of wood. In the white key 100*w*, a gap 152 is provided above the side surface key guide 153*w*. As described above, the gap 152 suppresses a case in which the side surface key guide 153 deforms due to deformation that accompanies change over time of the wooden portion 160.

On the other hand, the black keys 100*b* are all made of resin. The side surface key guide 153*b* of the black key 100*b*, which is not provided with the gap 152, is provided at a position higher than that of the side surface key guide 153*w* of the white key 100*w*.

Next, with the white key 100*w*, the front end key guide 151*w* is arranged at a different location in the front-rear direction of the key from the hammer support portion 120*w*. On the other hand, with the black key 100*b*, the front end key guide 151*b* and the hammer support portion 120*b* are arranged at approximately the same position in the front-rear direction of the key. That is, in the black key 100*b*, the hammer support portion 120*b* is arranged at the front end portion of the black key 100*b*. In other words, the hammer support portion 120*w* of the white key 100*w* is arranged in alignment with the position of the hammer support portion 120*b* of the black key 100*b*.

Operation of Keyboard Assembly

Figure 9:
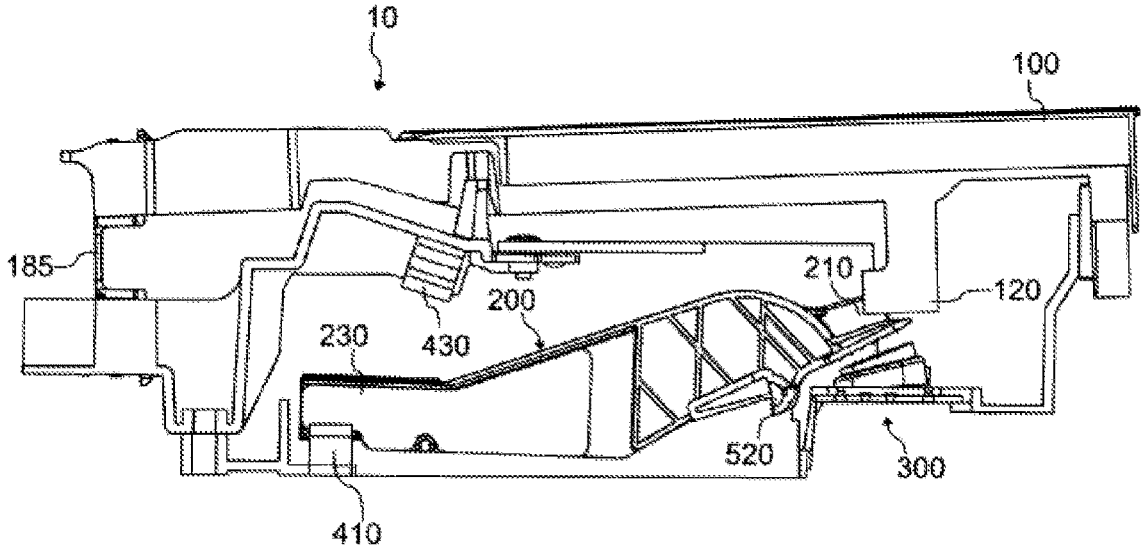
FIGS. 9(A) and 9(B) show diagrams illustrating an operation of a key assembly when a key (white key) of an embodiment of the present disclosure is pressed.
Figure 9:
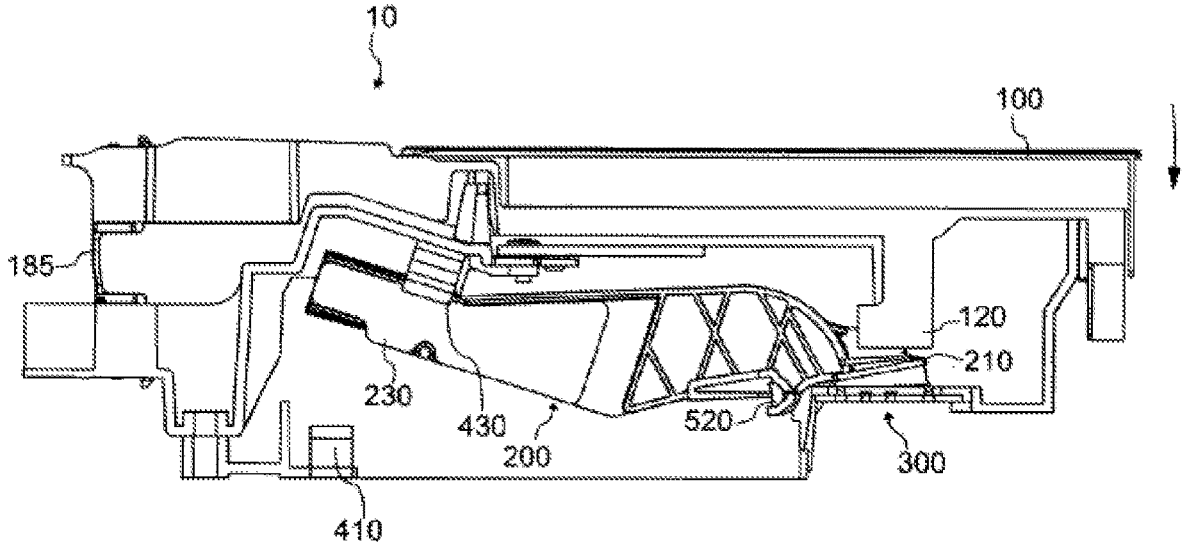

FIG. 9 shows diagrams illustrating operation of a key assembly when a key (white key) according to an embodiment of the present disclosure is pressed. FIG. 9(A) is a diagram showing a case in which a key 100 is at a rest position (the key is not being pressed). FIG. 9(B) is a diagram showing a case in which a key 100 is at an end portion (the key is fully pressed). When the key 100 is pressed, the rod-shaped flexible member 185 bends as the rotational center. Although the rod-shaped flexible member 185 performs a bending deformation toward the front (the frontward direction) of the key at this time, the key 100 does not move forward, but rotates in the pitch direction due to the restriction of movement in the front-rear direction by the side surface key guide 153. Then, due to the hammer support portion 120 pressing down the front end portion 210, the hammer assembly 200 rotates about the rotational axis 520. Accordingly, the weight portion 230 collides with the upper-side stopper 430, whereby the rotation of the hammer assembly 200 stops and the key 100 reaches the end position. Also, when the sensor 300 is pressed down by the front end portion 210, the sensor 300 outputs the detection signal in multiple steps corresponding to the amount by which it was pressed down (key press amount).

On the other hand, when the key is released, the weight portion 230 moves downward, whereby the hammer assembly 200 rotates, and the key 100 rotates upward. Due to the weight portion 230 coming into contact with the lower-side stopper 410, the rotation of the hammer assembly 200 stops and the key 100 returns to the rest position.

Characteristics

As described above, with the keyboard device 1 according to the first embodiment, due to the side surface frame guide 513 being arranged between adjacent keys 100, it is possible to suppress a case in which the adjacent keys 100 come into contact with each other even if the keys 100 move in the scale direction in the non-external portion NV. Accordingly, it is possible to suppress operation inconveniences that occur during key press or key release, which are caused by contact between the adjacent keys 100. That is, even if a key 100 is deformed, the influence of the deformation can be reduced. Note that the side surface frame guides 513 preferably slide on the protruding portions 115 of the keys 100 at locations that are as close as possible to the positions touched by the hand of the player. In the case of the white keys 100*w*, the gaps 152 are provided between the side surface key guides 153 and the upper surfaces of the keys 100, but in the case of the black keys 100*b*, gaps such as those of the white keys 100*w* are not provided, and therefore the side surface key guides 153 can be provided at positions higher than those of the white keys 100*w*. Accordingly, it is possible to improve the ability of guiding to the black keys 100*b*, to which an external force in the scale direction is likely to be applied due to the player touching them with his or her hand. Note that the sliding portion not only slides, but can also restrict movement of the key by merely coming into contact with the protruding portion. Thus, it can also be called a contact portion. The same applies to the following embodiments as well.

Second Embodiment

In the second embodiment, a keyboard device 1A including keys 100A and side surface frame guides 513A with configurations different from those of the keys 100 and the side surface frame guides 513 according to the first embodiment will be described.

Figure 10:
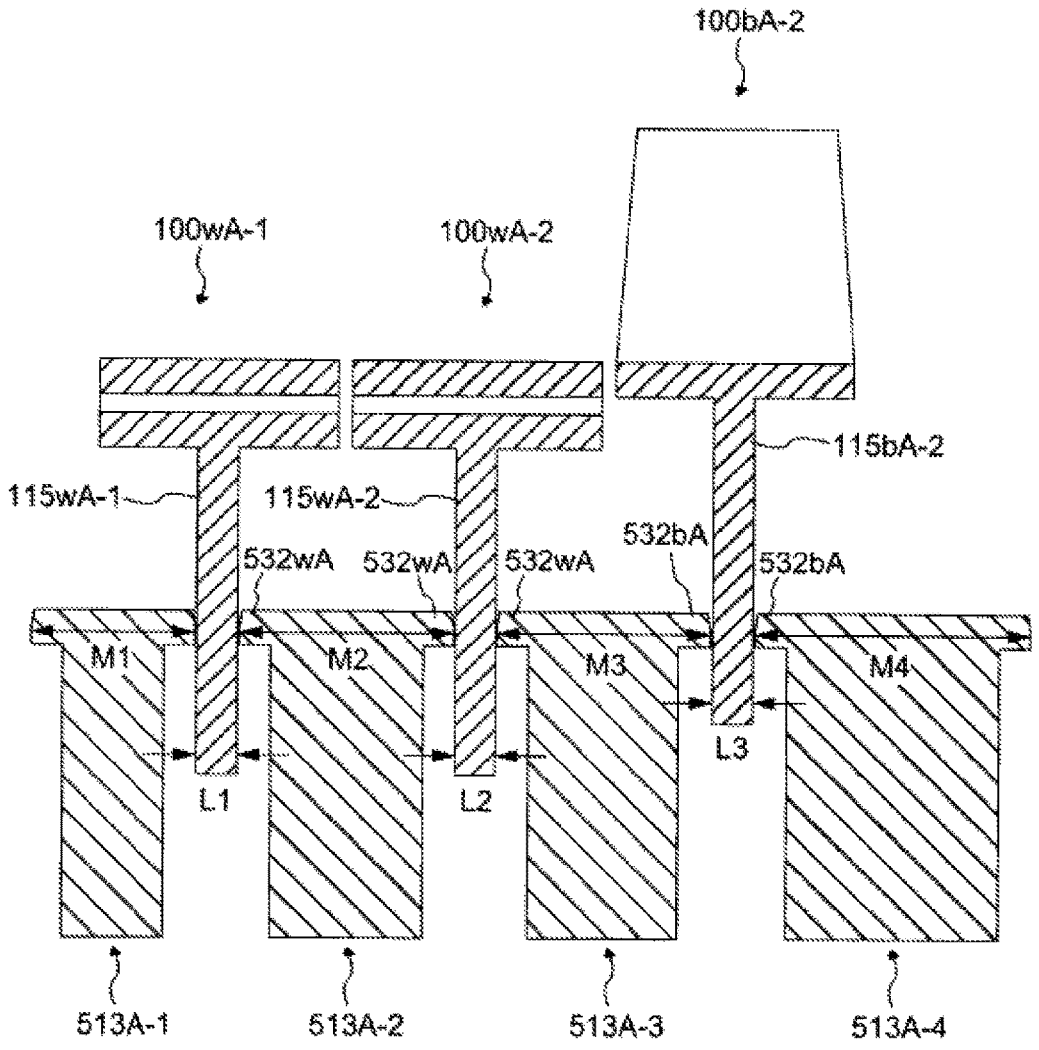
FIG. 10 is a cross-sectional diagram of keys and guides of a keyboard assembly of an embodiment of the present disclosure.

FIG. 10 is a cross-sectional diagram of keys and guides of a keyboard assembly of an embodiment of the present disclosure. Although the keys 100A and the side surface frame guides 513A shown in FIG. 10 are similar to the keys 100 and the side surface frame guides 513 (FIG. 5) of the first embodiment, they differ from the first embodiment in that the heights of the black key sliding portions 532*b*A and the white key sliding portions 532*w*A are the same, and in that the shapes of the protruding portions 115*w*A-1, 115*w*A-2, and 115*b*A-2 are the same. That is, the positions at which the black keys 100*b*A and the side surface frame guides 513A come into contact have the same height as the positions at which the white keys 100*w*A and the side surface frame guides 513A come into contact. Accordingly, the upper surfaces of all of the sliding portions 532 in this embodiment are formed into a flat shape. Also, in other words, the distance from the frame 500A of the black key sliding portion 532*b*A is the same as the distance from the frame of the white key sliding portion 532*w*A.

In FIG. 10, only the protruding portions 115A of the white keys 100*w*A-1 and 100*w*A-2 and the black key 100*b*A-2 were illustrated, but the protruding portions 115A of the all of the keys 100A arranged in the keyboard assembly 10A have the same shape. However, there is no limitation to this configuration, and the protruding portions 115*b*A of all of the black keys 100*b*A in one octave may have the same shape, the protruding portions 115*b*A may have a different shape from the protruding portions 115*w*A of the white keys 100*w*A, and the protruding portions 115*w*A of the multiple white keys 100*w*A may all have different shapes. In this case, the protruding portions 115*b*A can be used in common for all of the black keys 100*b*A. Note that in this case as well, the shapes of the protruding portions corresponding to the white keys for the same note in different octaves can be made the same. That is, the protruding portions 115*w*A can be used in common for the A keys, the B keys, the C keys, . . . , and the G keys, which are white keys in different octaves. Alternatively, the protruding portions 115*b*A of all of the black keys 100*b*A in one octave may have the same shape, the protruding portions 115*w*A of all of the white keys 100*w*A in one octave may have the same shape, and the shapes of the protruding portions 115*b*A of the black keys 100*b*A and the protruding portions 115*w*A of the white keys 100*w*A may have different shapes. In this case, the protruding portions 115*w*A can be used in common for all of the white keys 100*w*A, and the protruding portions 115*b*A can be used in common for all of the black keys 100*b*A. Note that by setting the shapes of the protruding portions 115A as described above, if the gaps of the protruding portions 115A between the adjacent keys 100A change according to the location, the arrangement of the keys 100A can be adjusted by setting the widths of the side surface frame guides 513A to different sizes.

As described above, with the keyboard device 1A according to the second embodiment, an effect similar to that of the first embodiment can be obtained. Furthermore, due to at least a portion of the protruding portions 115*w*A of the white keys 100*w*A in one octave and the protruding portions 115*b*A of the black key 100*b*A in one octave having the same shape, the protruding portions 115A with the same shape can be used in common for the multiple keys. Accordingly, by using the same components in common, manufacture can be performed rationally.

Third Embodiment

In the third embodiment, a keyboard device 1B including keys 100B and side surface frame guides 513B with configurations different from those of the keys 100A and the side surface frame guides 513A according to the second embodiment will be described.

Figure 11:
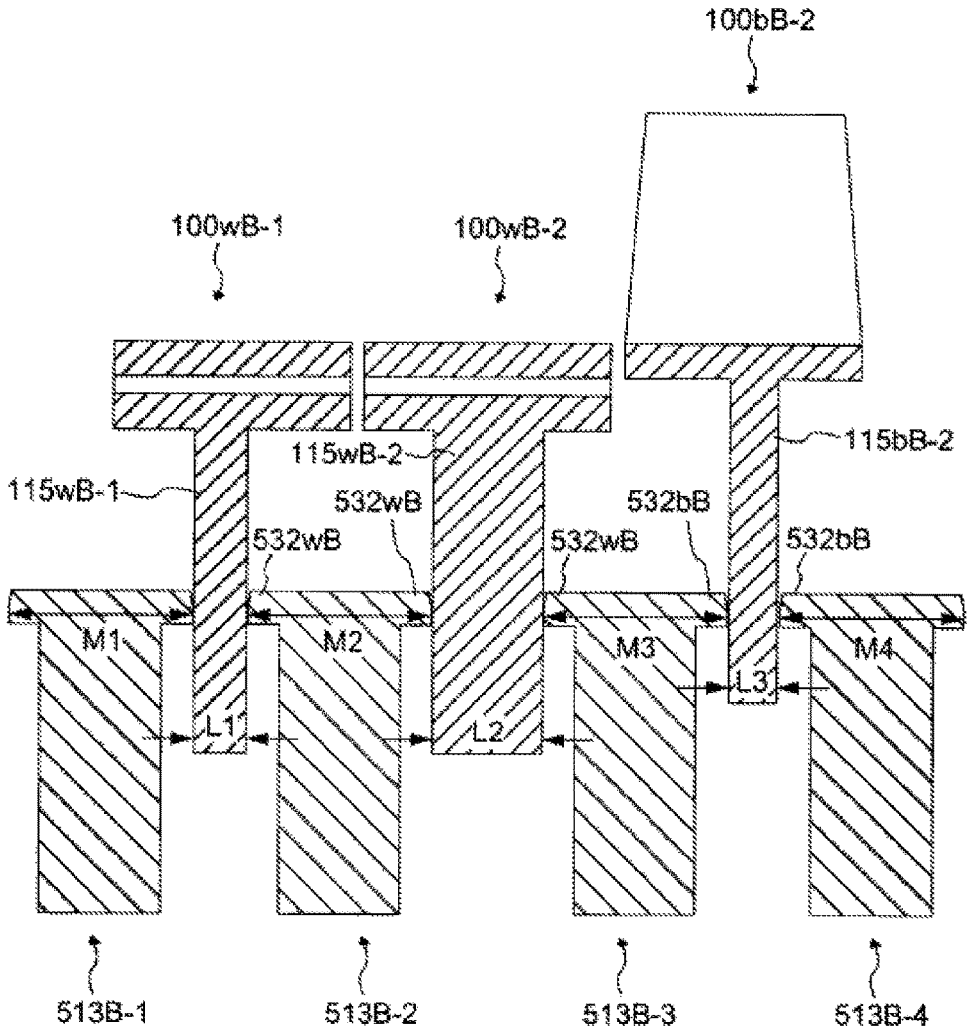
FIG. 11 is a cross-sectional diagram of keys and guides of a keyboard assembly of an embodiment of the present disclosure.

FIG. 11 is a cross-sectional diagram of keys and guides of a keyboard assembly of an embodiment of the present disclosure. With the keys 100B and side surface frame guides 513B shown in FIG. 11, the widths M1 to M4 in the scale direction of the side surface frame guides 513B are all the same, and the lengths L1 to L3 in the scale direction of the protruding portions 115B differ according to the keys 100B. Although FIG. 11 illustrates a configuration in which the width L2 of the protruding portion 115*w*B-2 is larger than the widths L1 and L3 of the protruding portions 115*w*B-1 and 115*b*B-2, there is no limitation to this.

With an existing keyboard assembly, the keys 100B are not arranged at even intervals, and therefore if all of the widths M1 to M4 of the side surface frame guides 513B are made the same, the distances between the adjacent side surface frame guides 513B will no longer be constant in some cases due to the arrangement intervals of the adjacent keys 100B. In the third embodiment, the adjacent side surface frame guides 513B and the protruding portions 115B can be slidably arranged according to the configuration in which the widths L1 to L3 of the protruding portions 115B are different. To rephrase the above-described configuration, the widths M1 to M4 of the multiple side surface frame guides 513B are the same, and the shapes of the protruding portions 115B interposed between the side surface frame guides 513B are different.

As described above, with the keyboard device 1B according to the third embodiment, an effect similar to that of the first embodiment can be obtained. Furthermore, due to the widths of the side surface frame guides 513B being identical, the side surface frame guides 513B incline to the same degree when the side surface frame guides 513B are pressed with the same force as shown in FIG. 6, and therefore the guide effect can be homogenized.

Fourth Embodiment

In the fourth embodiment, a keyboard device 1C including keys 100C and side surface frame guides 513C with configurations different from those of the keys 100B and the side surface frame guides 513B according to the third embodiment will be described.

Figure 12:
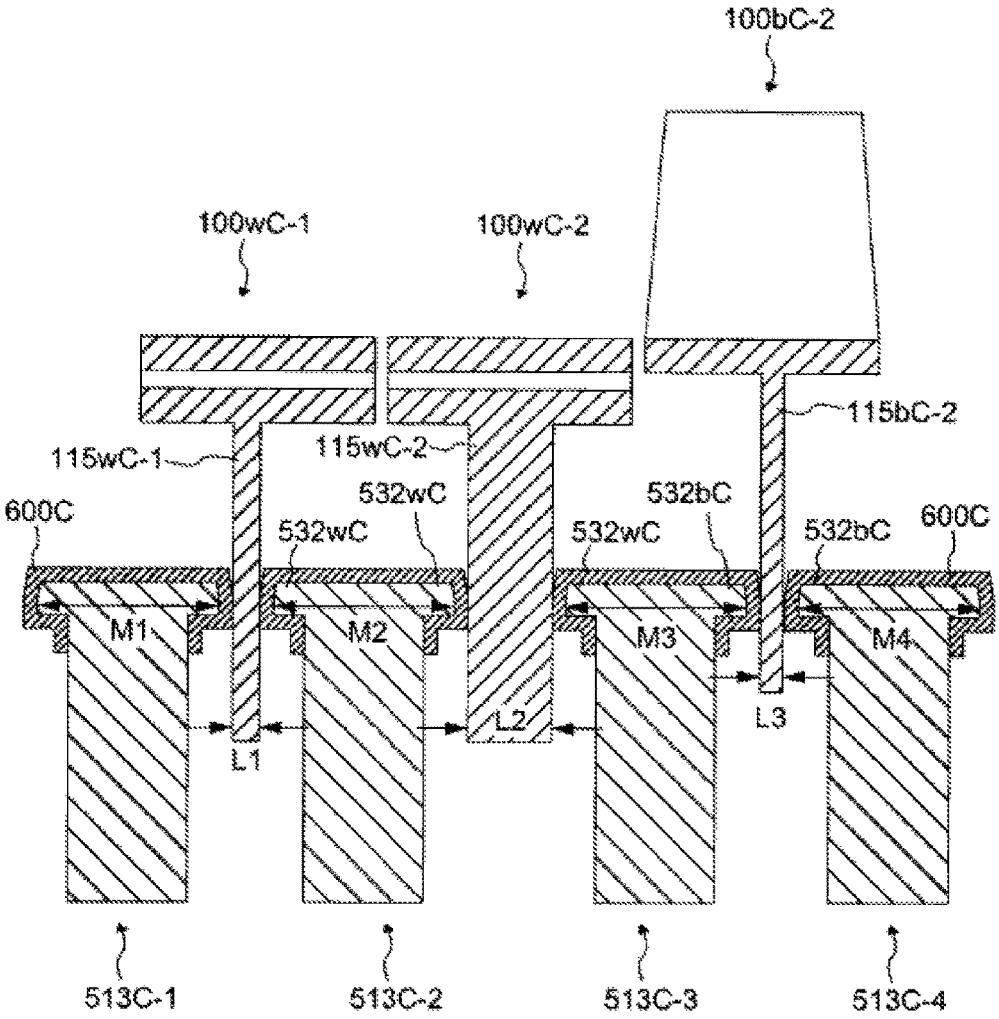
FIG. 12 is a cross-sectional diagram of keys and guides of a keyboard assembly of an embodiment of the present disclosure.

FIG. 12 is a cross-sectional diagram of keys and guides of a keyboard assembly of an embodiment of the present disclosure. The keys 100C and the side surface frame guides 513C shown in FIG. 12 are similar to the keys 100B and the side surface frame guides 513B (FIG. 11) of the third embodiment, but the keys 100C and side surface frame guides 513C differ from the third embodiment in that caps 600C covering the sliding portions 532C are provided between the sliding portions 532C and the protruding portions 115C of the side surface frame guides 513C. In FIG. 12, not only are the widths M1 to M4 of the side surface frame guides 513C-1 to 513C-4 the same, but their shapes are also the same. Note that the caps 600C need only be provided so as to slide on the protruding portions 115C between at least the sliding portion 532C and the protruding portion 115C, and the sliding portions 532C need not be covered. Note that the widths M1 to M4 of the side surface frame guides 513C-1 to 513C-4 may be different.

A material that is softer than that of the side surface frame guides 513C is used for the caps 600C. That is, the Young's modulus of the caps 600*s* is lower than the Young's modulus of the side surface frame guides 513C. The material of the caps 600C may be a material that is even softer than the protruding portions 115C. For example, a buffering material such as nonwoven cloth or an elastic body can be used for the caps 600C. Rubber such as nitrile rubber (NBR) or ethylene propylene diene rubber (EPDM), or an elastomer can be used as the elastic body, for example. As shown in FIG. 12, due to the shapes of the side surface frame guides 513C included in the keyboard assembly 10C being set to be identical, caps 600C with identical shapes can be attached to the side surface frame guides 513C.

As described above, with the keyboard device 1C according to the fourth embodiment, an effect similar to that of the first embodiment can be obtained. Furthermore, due to the protruding portions 115C sliding with the caps 600C sliding instead of with the sliding portions 532C, noise that occurs during a key press or key release operation of the keys 100C can be reduced. Furthermore, due to the shapes of the side surface frame guides 513C-1 to 513C-4 being the same, the caps 600C with identical shapes can be used in common for the multiple side surface frame guides 513C. Accordingly, by using the same components in common, manufacture can be performed rationally.

Fifth Embodiment

In the fifth embodiment, a keyboard device 1D including keys 100D and side surface frame guides 513D with configurations different from those of the keys 100B and the side surface frame guides 513B according to the third embodiment will be described.

Figure 13:
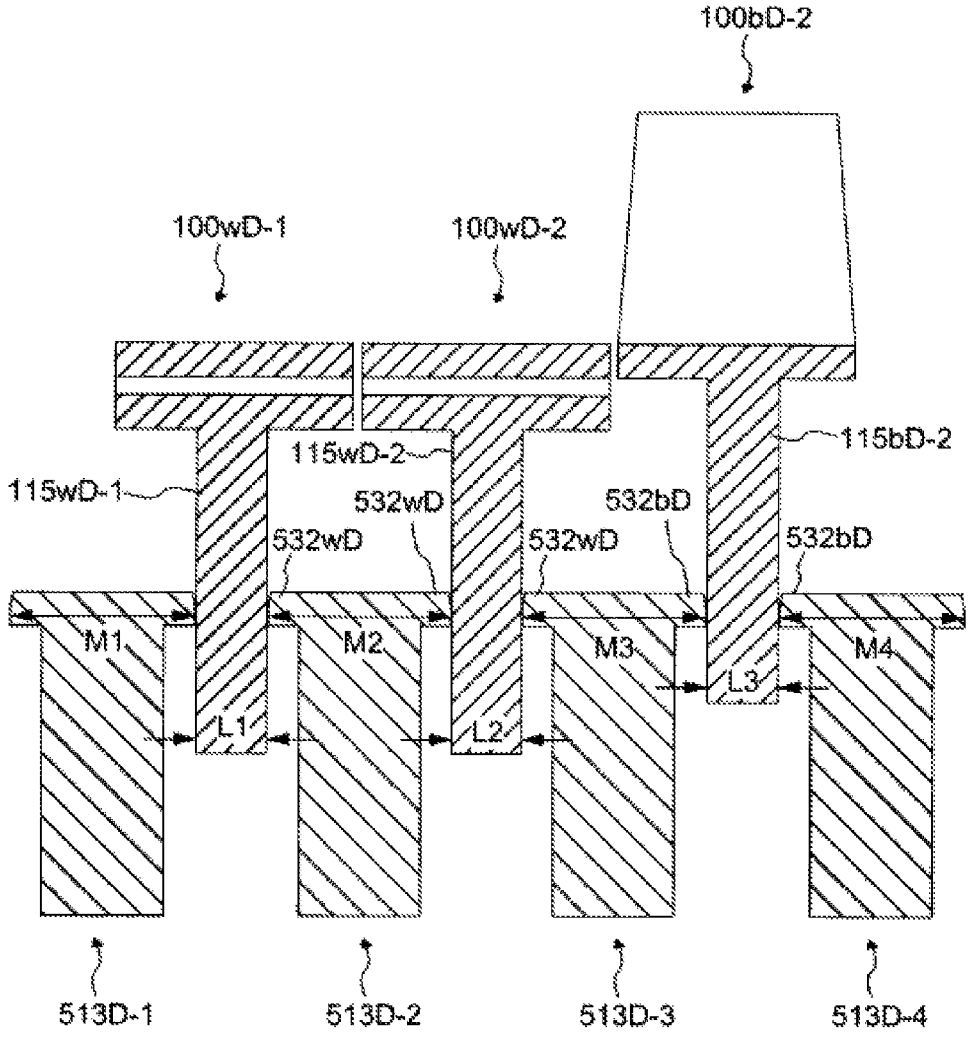
FIG. 13 is a cross-sectional diagram of keys and guides of a keyboard assembly of an embodiment of the present disclosure.

FIG. 13 is a cross-sectional diagram of keys and guides of a keyboard assembly of an embodiment of the present disclosure. Although the keys 100D and side surface frame guides 513D shown in FIG. 13 are similar to the keys 100B and the side surface frame guides 513B (FIG. 11) of the third embodiment, the keys 100D and the side surface frame guides 513D differ from the third embodiment in that the shapes of the protruding portions 115*w*D-1, 115*w*D-2, and 115*b*D-2 are the same. That is, the positional relationship between the upward member and the downward member with respect to the protruding portions 115*w*D-1, the positional relationship between the upward members and the downward members with respect to the protruding portions 115*w*D-2, and the positional relationship between the upward members and the downward members with respect to the protruding members 115*b*D-2 are the same. Furthermore, the widths L1 to L3 of the protruding portions 115*w*D-1, 115*w*D-2, and 115*b*D-2 are the same.

Note that in the fifth embodiment, the shapes of the keys of the existing keyboard assembly are changed and the keys 100D are arranged at even intervals, and thus the shapes of the protruding portions 115*w*D-1, 115*w*D-2, and 115*b*D-2 are the same. In this case, the shapes and arrangement of the keys 100D are adjusted to match the shapes of the above-described protruding portions 115D and side surface frame guides 513D. Note that not only the widths of the side surface frame guides 513D-1 to 513D-4 but also the shapes may be the same.

Note that FIG. 13 illustrates only the protruding portions 115D of the white keys 100*w*D-1 and 100*w*D-2 and the black keys 100*b*D-2, but the protruding portions of all of the keys arranged in the keyboard assembly 10D have the same shape. However, there is no limitation to this configuration, the protruding portions 115*b*D of all of the black keys 100*b*D in one octave may have the same shape, the protruding portions 115*b*D may have a different shape from the protruding portions 115*w*D of the white keys 100*w*D, and the protruding portions 115*w*D of the multiple white keys 100*w*D may each have different shapes. Alternatively, the protruding portions 115*b*D of all of the black keys 100*b*D in one octave may have the same shape, the protruding portions 115*w*D of all of the white keys 100*w*D in one octave may have the same shape, and the shapes of the protruding portions 115*b*D of the black keys 100*b*D and the protruding portions 115*wd* of the white keys 100*wd* may be different.

As described above, with the keyboard device 1D according to the fifth embodiment, an effect similar to that of the first embodiment can be obtained. Furthermore, due to at least one portion among the protruding portions 115*w*D of the white keys 100*w*D in one octave and the protruding portions 115*b*D of the black keys 100*b*D in one octave having the same shape, the protruding portions 115D with the same shape can be used in common for multiple keys. Accordingly, by using the same components in common, manufacture can be performed rationally. Furthermore, due to the widths of the side surface frame guides 513D being identical, the side surface frame guides 513D incline to the same degree when the side surface frame guides 513D are pressed with the same force as shown in FIG. 6, and therefore the guide effect can be homogenized. Furthermore, if the shapes of the side surface frame guides 513C-1 to 513C-4 are the same, caps with identical shapes can be used in common for the multiple side surface frame guides 513D.

Sixth Embodiment

In the sixth embodiment, a keyboard device 1E including keys 100E and side surface frame guides 513E with configurations different from those of the keys 100 and the side surface frame guides 513 according to the first embodiment will be described.

Figure 14:
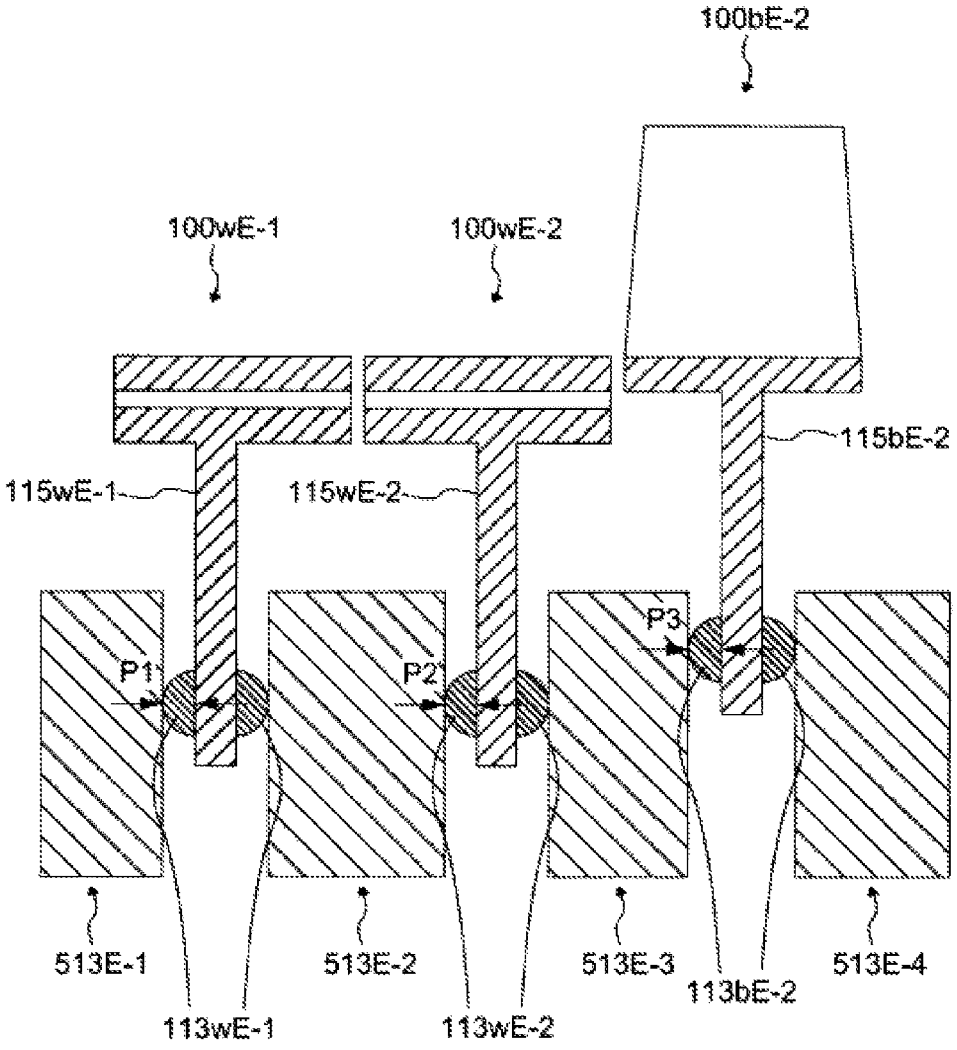
FIG. 14 is a cross-sectional diagram of keys and guides of a keyboard assembly of an embodiment of the present disclosure.

FIG. 14 is a cross-sectional diagram of keys and guides of a keyboard assembly of an embodiment of the present disclosure. As shown in FIG. 14, sliding portions 113*w*E-1, 113*w*E-2, and 113*b*E-2 are provided on both side surfaces in the scale direction of the protruding portions 115*w*E-1, 115*w*E-2, and 115*b*E-2 respectively. On the other hand, the sliding portions are not provided on the side surface frame guides 513E-1 to 513E-4. However, the sliding portions 532 shown in FIG. 5 may be provided on the side surface frame guides 513E-1 to 513E-4. Protruding members that are hemispherical in cross section and have the same sizes P1 to P3 are provided as the sliding portions 113*w*E-1, 113*w*E-2, and 113*b*E-2 on both side surfaces of the protruding portions 115*w*E-1, 115*w*E-2, and 115*b*E-2, and the widths of the side surface frame guides 513E-1 to 513E-4 differ according to the arrangement of the keys 100E. Here, the sizes P1 to P3 of the above-described sliding portions 113E correspond to the distances between the protruding portions 115E and the side surface frame guides 513E. However, the shapes of the sliding portions 113*w*E-1, 113*w*E-2, and 113*b*E-2 are not particularly limited, as long as they come into contact with the side surface frame guides 513E-1 to 513E-4. This point also applies to the mode shown in FIG. 15, which will be described next.

Figure 15:
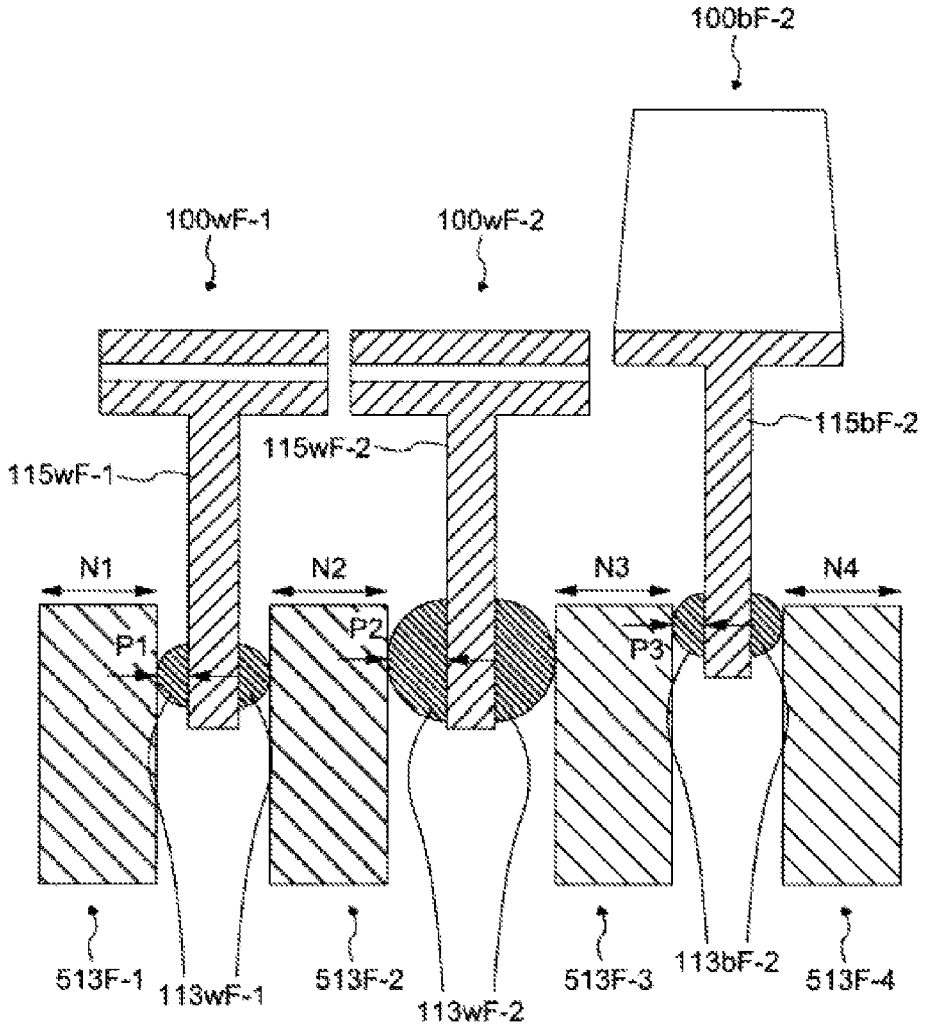
FIG. 15 is a cross-sectional diagram of keys and guides of a keyboard assembly of an embodiment of the present disclosure.

FIG. 15 is a cross-sectional diagram of keys and guides of a keyboard assembly of a modified example of an embodiment of the present disclosure. As shown in FIG. 15, widths N1 to N4 of the side surface frame guides 513F-1 to 513F-4 are the same, the shapes of protruding portions 115*w*F-1, 115*w*F-2, and 115*b*F-2 are the same, and sizes P1 to P3 of the sliding portions 113*w*F-1, 113*w*F-2, and 113*b*F-2 differ according to the interval between the protruding portions 115F and the side surface frame guides 513F. Specifically, the size P2 of the sliding portion 113*w*F-2 between the protruding portion 115*w*F-2 and the side surface frame guides 513F-2 and 513F-3 is larger compared to the size P1 of the sliding portion 113*w*F-1 between the protruding portion 115*w*F-1 and the side surface frame guides 513F-1 and 513F-2 and the size P3 of the sliding portion 113*b*F-2 between the protruding portion 115*b*F-2 and the side surface frame guides 513F-3 and 513F-4.

As described above, with the keyboard device 1F according to the sixth embodiment, an effect similar to that of the first embodiment can be obtained. Furthermore, even if the sliding portions are not provided on the side surface frame guides 513F, an effect similar to that of the first embodiment can be obtained by arranging the sliding portions 113F on the protruding portions 115F. Furthermore, by adjusting the sizes of the sliding portions 113F arranged on the protruding portions 115F, the widths of the side surface frame guides 513F and the shapes of the protruding portions 115F can be made the same. That is, the protruding portions 115F with the same shape can be used in common for the multiple keys, and if the side surface frame guides 513F are covered with caps, caps with identical shapes can be used in common for the multiple side surface frame guides 513F. Accordingly, by using the same components in common, manufacture can be performed rationally.

In the above-described embodiments, an electronic piano was indicated as an example of a keyboard device to which the keys and side surface frame guides were applied. On the other hand, the keys and side surface frame guides of the above-described embodiments can also be applied to an acoustic piano (grand piano, upright piano, etc.). In this case, the sound generating mechanism corresponds to the hammers and strings. The rotation mechanism of the above-described embodiments can also be applied to a rotation component other than that of a piano.

Note that the present disclosure is not limited to the above-described embodiments and can be modified as appropriate without departing from the gist. For example, the aspects shown in the above-described embodiments can be combined as appropriate.

The invention claimed is:

1. A keyboard device comprising:

a plurality of white keys;

a plurality of black keys; and a plurality of guides each arranged between a pair of adjacent black and white keys, among the plurality of white keys and the plurality of black keys, and that restrict operation by coming into contact with the pair of adjacent black and white keys, wherein each of the plurality of guides has a same width in a scale direction, wherein each of the plurality of white keys and the plurality of black keys includes an upper surface portion and a protruding portion that protrudes downward from the upper surface portion, wherein each of the protruding portions includes a side surface key guide in contact with adjacent guides among the plurality of guides, wherein each of the plurality of white keys includes a gap disposed above the side surface key guide, and disposed between the upper surface portion and the protruding portion, wherein each of the protruding portions of the plurality of black keys has a same width in the scale direction, and wherein each of the protruding portions of the plurality of white keys for a same note in different octaves has a same width in the scale direction.

2. The keyboard device according to claim 1, further comprising:

a housing that covers part of the plurality of white keys and the plurality of black keys, wherein the plurality of guides are arranged in a region covered by the housing.

3. The keyboard device according to claim 1, wherein each of the plurality of guides includes a cap that has a lower Young's modulus than the plurality of guides.

4. The keyboard device according to claim 1, wherein the shapes of at least two of the protruding portions of the plurality of white keys and the plurality of black keys are different.

5. The keyboard device according to claim 1, wherein the shapes of the protruding portions corresponding to the plurality of white keys and the plurality of black keys are the same.

6. The keyboard device according to claim 1, wherein the shapes of the protruding portions corresponding to the plurality of white keys are the same.

7. The keyboard device according to claim 1, wherein the shapes of the protruding portions corresponding to the plurality of black keys are the same.

8. The keyboard device according to claim 1, wherein the protruding portions and the plurality of guides are configured to come into contact.

9. The keyboard device according to claim 8, wherein:

each of the protruding portions includes a downward member that protrudes downward, and each of the plurality of guides is configured to come into contact with side surfaces in the scale direction of the downward members.

10. The keyboard device according to claim 1, wherein a position at which a black key, among the plurality of black keys, and a guide, among the plurality of guides, come into contact is above a position at which a white key, among the plurality of white keys, and the guide come into contact.

11. The keyboard device according to claim 1, wherein a position at which a black key, among the plurality of black keys, and a guide, among the plurality of guides, come into contact is at a same height in a vertical direction as a position at which a white key, among the plurality of white keys and the guide come into contact.

12. The keyboard device according to claim 1, wherein:

each of the plurality of guides includes a contact portion that extends in the scale direction, and the contact portions of the plurality of guides come into contact with and restrict operation of the plurality of white keys and the plurality of black keys.

13. The keyboard device according to claim 1, wherein:

each of the plurality of white keys and the plurality of black keys includes a contact portion that extends in the scale direction, and the contact portions of the plurality of white keys and the plurality of black keys come into contact with the plurality of guides and restrict operation of the plurality of white keys and the plurality of black keys.

14. The keyboard device according to claim 1, further comprising:

a hammer assembly configured to rotate in response to pressing of each of the plurality of white keys or the plurality of black keys;

a sensor arranged below each of the plurality of white keys and the plurality of black keys and configured to detect operation of the respective white or black key; and a sound source unit configured to generate a sound waveform signal according to an output signal of the sensors.

* * * * *